US011206963B2

(12) United States Patent
Mathias et al.

(10) Patent No.: US 11,206,963 B2
(45) Date of Patent: Dec. 28, 2021

(54) CLEANING DEVICE SYSTEM AND METHOD FOR USE

(71) Applicant: SharkNinja Operating LLC, Needham, MA (US)

(72) Inventors: Richard Mathias, Needham, MA (US); Michael James Douglas, London (GB); Yu Ri Young Kim, Brighton, MA (US)

(73) Assignee: Sharkninja Operating LLC, Needham, MA (US)

( * ) Notice: Subject to any disclaimer, the term of this patent is extended or adjusted under 35 U.S.C. 154(b) by 0 days.

(21) Appl. No.: 17/089,532

(22) Filed: Nov. 4, 2020

(65) Prior Publication Data

US 2021/0251447 A1 Aug. 19, 2021

Related U.S. Application Data

(63) Continuation of application No. 16/795,012, filed on Feb. 19, 2020.

(51) Int. Cl.

| | |
|---|---|
| ***A47L 9/06*** | (2006.01) |
| ***A47L 13/16*** | (2006.01) |
| ***A47L 13/24*** | (2006.01) |

(52) U.S. Cl.

CPC ..... *A47L 9/0673* (2013.01); *A47L 13/16* (2013.01); *A47L 13/24* (2013.01)

(58) Field of Classification Search

CPC ..... A47L 9/0673; A47L 13/16; A47L 13/24

See application file for complete search history.

(56) References Cited

U.S. PATENT DOCUMENTS

| | | | |
|---|---|---|---|
| 490,472 | A | 1/1893 | Clements |
| 2,055,734 | A | 9/1936 | Sparklin |
| D117,388 | S | 10/1939 | Woinarovicz |
| 3,050,761 | A | 8/1962 | Morgan |
| D214,977 | S | 8/1969 | Roth |
| D247,949 | S | 5/1978 | Tillinghast et al. |
| D250,245 | S | 11/1978 | Bebb |
| D278,099 | S | 3/1985 | Evans |
| 4,545,794 | A | 10/1985 | Himukai |
| 4,706,327 | A | 11/1987 | Getz et al. |
| 5,365,881 | A | 11/1994 | Sporn |

(Continued)

FOREIGN PATENT DOCUMENTS

| | | | |
|---|---|---|---|
| CN | 1764405 | A | 4/2006 |
| CN | 1889881 | A | 1/2007 |

(Continued)

OTHER PUBLICATIONS

International Search Report and Written Opinion received for PCT Application No. PCT/IB2020/062158, dated Mar. 24, 2021, 11 pages.

(Continued)

*Primary Examiner* — David Redding

(74) *Attorney, Agent, or Firm* — Mintz Levin Cohn Ferris Glovsky and Popeo, PC; Lisa Adams

(57) ABSTRACT

A cleaning device is removably attachable to a replacement head. The replacement head includes pad that is attached to the lower side of an attachment member and is in contact with the floor during cleaning. The cleaning device is removably attached to the attachment member of the replacement head by lowering the cleaning device body downward vertically onto the replacement head until a mechanical connection is achieved.

21 Claims, 22 Drawing Sheets

(56) References Cited

U.S. PATENT DOCUMENTS

| | | | |
|---|---|---|---|
| 5,664,285 | A | 9/1997 | Melito et al. |
| 5,829,090 | A | 11/1998 | Melito et al. |
| D423,157 | S | 4/2000 | Hodges |
| 6,102,278 | A | 8/2000 | Rothas |
| 6,117,200 | A | 9/2000 | Berg et al. |
| 6,453,506 | B1 | 9/2002 | Sumner |
| 6,571,421 | B1 | 6/2003 | Sham et al. |
| 6,797,357 | B2 | 9/2004 | Fereshtehkhou et al. |
| 6,799,351 | B2 | 10/2004 | Porath |
| 6,966,098 | B2 | 11/2005 | Sako et al. |
| 7,013,528 | B2 | 3/2006 | Parker et al. |
| 7,048,804 | B2 | 5/2006 | Kisela et al. |
| 7,137,169 | B2 | 11/2006 | Murphy et al. |
| 7,150,069 | B2 | 12/2006 | Hori et al. |
| D548,907 | S | 8/2007 | Killen |
| 7,293,322 | B2 | 11/2007 | Matousek et al. |
| 7,329,294 | B2 | 2/2008 | Conrad |
| 7,337,494 | B2 | 3/2008 | Baer et al. |
| 7,409,745 | B2 | 8/2008 | Dodson et al. |
| 7,418,763 | B2 | 9/2008 | Shaver et al. |
| 7,451,519 | B2 | 11/2008 | Nishinaka et al. |
| D597,717 | S | 8/2009 | Rosenzweig et al. |
| 7,673,361 | B2 | 3/2010 | Policicchio et al. |
| 7,676,877 | B2 | 3/2010 | Policicchio et al. |
| 7,861,351 | B2 | 1/2011 | Ho |
| 7,934,287 | B2 | 5/2011 | De Soto-Burt et al. |
| 8,020,236 | B2 | 9/2011 | Kaleta et al. |
| 8,062,398 | B2 | 11/2011 | Luo et al. |
| 8,065,778 | B2 | 11/2011 | Kim et al. |
| D661,034 | S | 5/2012 | Ediger et al. |
| D672,107 | S | 12/2012 | Van Landingham, Jr. et al. |
| 8,341,802 | B2 | 1/2013 | Kim et al. |
| 8,458,850 | B2 | 6/2013 | Kasper et al. |
| 8,495,781 | B2 | 7/2013 | Dingert |
| 8,584,309 | B2 | 11/2013 | Santiago |
| D703,407 | S | 4/2014 | Xiong |
| D731,137 | S | 6/2015 | Colangelo |
| D764,127 | S | 8/2016 | Vicari et al. |
| D766,584 | S | 9/2016 | Blouin et al. |
| 9,504,366 | B2 | 11/2016 | Kasper et al. |
| 9,545,180 | B2 | 1/2017 | Conrad |
| 9,560,944 | B2 | 2/2017 | Grey |
| 9,661,968 | B2 | 5/2017 | Bradbury |
| 9,788,695 | B2 | 10/2017 | Wood |
| D804,123 | S | 11/2017 | Orsino |
| 9,883,780 | B2 | 2/2018 | Kim et al. |
| 9,901,231 | B2 | 2/2018 | Tibberts |
| D817,574 | S | 5/2018 | Libman et al. |
| 2003/0159230 | A1 | 8/2003 | Oh |
| 2003/0217432 | A1 | 11/2003 | Oh et al. |
| 2003/0221274 | A1 | 12/2003 | Makhija et al. |
| 2004/0045126 | A1 | 3/2004 | Parker et al. |
| 2004/0134016 | A1 | 7/2004 | Kisela et al. |
| 2004/0134025 | A1 | 7/2004 | Murphy et al. |
| 2004/0139572 | A1 | 7/2004 | Kisela et al. |
| 2004/0141798 | A1 | 7/2004 | Garabedian et al. |
| 2004/0168281 | A1 | 9/2004 | Sako et al. |
| 2004/0211022 | A1 | 10/2004 | Fan |
| 2004/0250376 | A1 | 12/2004 | Hori et al. |
| 2005/0115409 | A1 | 6/2005 | Conrad |
| 2005/0132680 | A1 | 6/2005 | Wegelin et al. |
| 2005/0193516 | A1 | 9/2005 | Hughes |
| 2006/0000052 | A1 | 1/2006 | Budd |
| 2006/0123590 | A1 | 6/2006 | Fester et al. |
| 2007/0061040 | A1 | 3/2007 | Augenbraun et al. |
| 2007/0245511 | A1 | 10/2007 | Hahm et al. |
| 2007/0251050 | A1 | 11/2007 | Harsh et al. |
| 2008/0040876 | A1 | 2/2008 | Aiyar |
| 2008/0235899 | A1 | 10/2008 | Haan |
| 2008/0276407 | A1 | 11/2008 | Schnittman et al. |
| 2009/0100636 | A1 | 4/2009 | Sohn et al. |
| 2010/0024155 | A1 | 2/2010 | Policicchio et al. |
| 2010/0024156 | A1 | 2/2010 | De et al. |
| 2010/0024157 | A1 | 2/2010 | Vernon et al. |
| 2010/0115719 | A1 | 5/2010 | West et al. |
| 2010/0251497 | A1 | 10/2010 | Arnold |
| 2010/0306939 | A1 | 12/2010 | Dingert |
| 2011/0088209 | A1 | 4/2011 | Ivarsson |
| 2012/0110775 | A1 | 5/2012 | Krebs |
| 2012/0159728 | A1 | 6/2012 | Suda et al. |
| 2012/0311813 | A1 | 12/2012 | Gilbert et al. |
| 2013/0055521 | A1 | 3/2013 | Lee et al. |
| 2013/0291333 | A1 | 11/2013 | Grey |
| 2014/0033470 | A1 | 2/2014 | Codling |
| 2014/0033471 | A1 | 2/2014 | Toole et al. |
| 2015/0101617 | A1 | 4/2015 | Duffy |
| 2015/0128364 | A1 | 5/2015 | Dooley et al. |
| 2015/0223662 | A1 | 8/2015 | Doherty-Stapp et al. |
| 2015/0250368 | A1 | 9/2015 | Kim et al. |
| 2016/0100735 | A1 | 4/2016 | Milanese et al. |
| 2016/0174793 | A1 | 6/2016 | Burke et al. |
| 2016/0278594 | A1 | 9/2016 | Bradbury |
| 2016/0353963 | A1 | 12/2016 | Kellis et al. |
| 2017/0007086 | A1 | 1/2017 | Kleine-Doepke et al. |
| 2017/0119223 | A1 | 5/2017 | Staf |
| 2017/0202421 | A1 | 7/2017 | Hwang et al. |
| 2018/0014711 | A1 | 1/2018 | Rostami |
| 2018/0035855 | A1 | 2/2018 | Wood |
| 2018/0055315 | A1 | 3/2018 | Conrad |
| 2018/0177367 | A1 | 6/2018 | Amaral et al. |
| 2018/0220861 | A1 | 8/2018 | Zhang et al. |
| 2019/0075984 | A1 | 3/2019 | James et al. |
| 2019/0269289 | A1 | 9/2019 | Xu et al. |
| 2019/0274500 | A1 | 9/2019 | Thorne et al. |

FOREIGN PATENT DOCUMENTS

| | | | |
|---|---|---|---|
| CN | 101061929 | A | 10/2007 |
| CN | 102112030 | A | 6/2011 |
| CN | 102961085 | A | 3/2013 |
| CN | 103356140 | A | 10/2013 |
| CN | 205181229 | U | 4/2016 |
| CN | 107028564 | A | 8/2017 |
| CN | 209595637 | U | 11/2019 |
| DE | 667452 | C | 11/1938 |
| EP | 1027844 | A2 | 8/2000 |
| EP | 1525839 | A2 | 4/2005 |
| JP | 2003326121 | A | 11/2003 |
| JP | 2006198083 | A | 8/2006 |
| JP | 2008228768 | A | 10/2008 |
| JP | D1489801 | S | 2/2014 |
| KR | 1020060112749 | A | 11/2006 |
| KR | 20170043227 | A | 4/2017 |
| WO | 2004062454 | A2 | 7/2004 |
| WO | 2004062457 | A2 | 7/2004 |
| WO | 2005018402 | A2 | 3/2005 |
| WO | 2010014366 | A1 | 2/2010 |
| WO | 2010014367 | A1 | 2/2010 |
| WO | 2011017493 | A2 | 2/2011 |
| WO | 2011112545 | A2 | 9/2011 |
| WO | 2014020303 | A1 | 2/2014 |
| WO | 2014104503 | A1 | 7/2014 |
| WO | 2016022270 | A1 | 2/2016 |
| WO | 2016062647 | A1 | 4/2016 |
| WO | 2016095040 | A1 | 6/2016 |
| WO | 2016100964 | A2 | 6/2016 |
| WO | 2017144918 | A1 | 8/2017 |

OTHER PUBLICATIONS (2016) Amazon.com—Shark Genius Steam Pocket Mop Hard Floor Cleaner, oldest reviews 2016, https:/lwww.amazon.com/cleaner-Blaster-Technology-Intelligent-S5003D/dp/B01 KU4BSGK/ref=cm_cr arp_d_product_top?ie=UTF8, 11 pages.

Extended European Search Report received for EP Application No. 18854457.1, dated Apr. 2, 2020, 5 pages.

Extended European Search Report received for EP Application No. 19215569.5, dated May 15, 2020, 5 pages.

International Preliminary Report on Patentability received for PCT Application No. PCT/US2018/050308, dated Mar. 26, 2020, 13 pages.

(56) References Cited

OTHER PUBLICATIONS

International Search Report and Written Opinion received for PCT Application No. PCT/US2019/059327, dated Feb. 6, 2020, 10 pages.
International Search Report and Written Opinion received for PCT Application No. PCT/US2018/050308, dated Nov. 26, 2018, 15 pages.
International Search Report and Written Opinion received for PCT Application No. PCT/US2019/067121, dated May 7, 2020, 12 pages.
International Search Report and Written Opinion received for PCT Application No. PCT/US2020/058146, dated Feb. 2, 2021, 13 pages.
International Search Report and Written Opinion received for PCT Application No. PCT/US2020/058162, dated Feb. 2, 2021, 12 pages.
International Search Report and Written Opinion received for PCT Application No. PCT/US2020/059491, dated Feb. 2, 2021, 9 pages.
International Search Report and Written Opinion received for PCT Application No. PCT/US2020/059503, dated Feb. 3, 2021, 7 pages.
International Search Report and Written Opinion received in PCT Application No. PCT/US2020/058195, dated Dec. 21, 2020, 13 pages.
Invitation to Pay Additional Fees received for PCT Application No. PCT/US2020/062158, mailed on Jan. 11, 2021, 2 pages.
(Aug. 1, 2019) N.K. Multi-Tech Filters Pvt. Limited, Available at: https://www.airfiltersindia.net/product_temp_No_Upload.html, 4 Pages.
U.S. Appl. No. 16/718,875, filed Dec. 18, 2019, Cleaning Device.
U.S. Appl. No. 16/670,103, filed Oct. 31, 2019, Replacement Head for a Vacuum.
U.S. Appl. No. 16/670,039, filed Oct. 31, 2019, Replacement Head for a Vacuum.
U.S. Appl. No. 16/670,476, filed Oct. 31, 2019, Comet, Replacement Head Filter.
U.S. Appl. No. 16/126,549, filed Sep. 10, 2018, Cleaning Device.
U.S. Appl. No. 16/420,453, filed May 23, 2019, Cleaning Device.
U.S. Appl. No. 16/420,475, filed May 23, 2019, Cleaning Device.
U.S. Appl. No. 16/420,498, filed May 23, 2019, Cleaning Device.
U.S. Appl. No. 16/429,306, filed Jun. 3, 2019, Cleaning Device.
U.S. Appl. No. 16/896,762, filed Jun. 9, 2020, Cleaning Device.
U.S. Appl. No. 17/038,975, filed Sep. 30, 2020, Cleaning Device.
U.S. Appl. No. 17/039,057, filed Sep. 30, 2020, Cleaning Device.
U.S. Appl. No. 17/039,103, filed Sep. 30, 2020, Cleaning Device.
U.S. Appl. No. 17/039,155, filed Sep. 30, 2020, Cleaning Device.
U.S. Appl. No. 17/039,814, filed Sep. 30, 2020, Cleaning Device.
U.S. Appl. No. 17/039,725, filed Sep. 30, 2020, Cleaning Device.
U.S. Appl. No. 17/062,432, filed Oct. 2, 2020, Cleaning Device.
U.S. Appl. No. 17/062,455, filed Oct. 2, 2020, Cleaning Device.
U.S. Appl. No. 17/062,489, filed Oct. 2, 2020, Cleaning Device.
U.S. Appl. No. 17/062,540, filed Oct. 2, 2020, Cleaning Device.
U.S. Appl. No. 17/067,537, filed Oct. 9, 2020, Cleaning Device.
U.S. Appl. No. 17/089,555, filed Nov. 4, 2020, Cleaning Device.
U.S. Appl. No. 16/671,220, filed Nov. 1, 2019, Cleaning Device.
U.S. Appl. No. 17/089,575, filed Nov. 4, 2020, Cleaning Device.
U.S. Appl. No. 16/718,725, filed Dec. 18, 2019, Cleaning Device.
U.S. Appl. No. 17/039,137, filed Sep. 30, 2020, Cleaning Device.
U.S. Appl. No. 17/091,983, filed Nov. 6, 2020, Cleaning Device.
U.S. Appl. No. 17/104,229, filed Nov. 25, 2020, Cleaning Device.
U.S. Appl. No. 17/091,945, filed Nov. 6, 2020, Cleaning Device.
U.S. Appl. No. 17/067,521, filed Oct. 9, 2020, Cleaning Device System and Method for Use.
U.S. Appl. No. 16/795,012, filed Feb. 19, 2020, Cleaning Device System and Method for Use.

CLEANING DEVICE SYSTEM AND METHOD FOR USE

CROSS-REFERENCE TO RELATED APPLICATIONS

This application claims priority under 35 U.S.C. 120 and is a continuation of U.S. patent application Ser. No. 16/795,012, entitled "CLEANING DEVICE SYSTEM AND METHOD OF USE" and filed Feb. 19, 2020.

FIELD OF THE INVENTION

The present disclosure relates generally to cleaning devices, and more specifically to the manner and method of connection between a cleaning device and a replacement head.

BACKGROUND

Hardfloor cleaning can be challenging when there are a variety of mixed media debris present. In some instances, there is a desire to both vacuum dry, loose debris, scrub stuck debris and absorb any wet debris that may be present. Prior art tools, such as vacuums, dry mops and wet mops are capable of handling some of these types of media, but not all at once. As a result, many often sweep dry debris before mopping wet or stuck-on debris.

Known tools that can handle both dry and wet media have higher set-up times than a broom/mop combination and the after-use maintenance can be especially high when liquids are involved. If the combination tool is not properly cleaned after each use, they can become smelly and unpleasant. Lastly, clean up can be quite messy and the user may be required to either dirty his or her hands and/or wear gloves.

Prior art cleaning devices that utilize, at least in part, a handle and replaceable cleaning sheet require the user to manually wrap a non-rigid cleaning sheet around the end of the mop handle before use. The process typically requires the user to use both hands and can be awkward. In embodiments where the non-rigid cleaning sheet is pre-wetted, users often must get their hands wet in order to the use the mop.

Therefore, an improved replacement head that can be easily attached and detached to a cleaning device with minimal effort and mess is desired.

SUMMARY

A cleaning device system includes a cleaning device and a selectively attachable replacement head. The replacement head includes at least one cleaning sheet that defines a first surface and a second surface that is generally opposite the first surface. The second surface is intended to clean a surface, such as a floor. The replacement head also includes an attachment member that is affixed to the first surface of the cleaning sheet. In some embodiments, the attachment member can be a plastic tray that includes a dust bin. A filter can also, optionally, be provided affixed to the dust bin. The cleaning device includes a generally elongated handle and a cavity at a distal end. The cleaning device and replacement head are removably attached to one another by, first, placing the replacement head in a manner such that the cleaning sheet is generally horizontal. Second, the cleaning device is lowered towards the replacement head in a generally vertical manner such that at least a portion of the attachment member enters into the cavity. Finally, a removable mechanical connection is initiated between the attachment member and the cavity of the cleaning device upon completion of the process.

According to another aspect of the invention, the attachment member (e.g., the plastic tray) includes a front guard portion that defines an interior space, and at least a portion of the cleaning device is lowered into the interior space during the connection process.

According to a further aspect of the present invention, at least a portion of the cleaning device is also in contact with the first surface of the cleaning sheet when connected to the replacement head.

According to an even further aspect of the present invention, the cavity on the cleaning device includes at least one interior wall that angles inward such that the replacement head is urged towards proper alignment with the cavity for proper connection.

According to an even further aspect of the present invention, the attachment member includes at least one connector lip and the cavity includes at least one movable connector arm that form the mechanical connection when the at least one connector lip passes by the at least one connector arm.

One advantage of the present invention is that a user can complete the connection process between the cleaning device and the replacement head with a single hand by simply lowering the cleaning device body vertically downward onto the replacement head.

Another advantage of the present invention is that the user does not have to hold both the cleaning device and the replacement head simultaneously during the connection process.

A further advantage of the present invention is that the angled interior walls of the cavity urge the replacement head into proper alignment during the connection process.

DETAILED DESCRIPTION OF THE INVENTION

Figure 1:
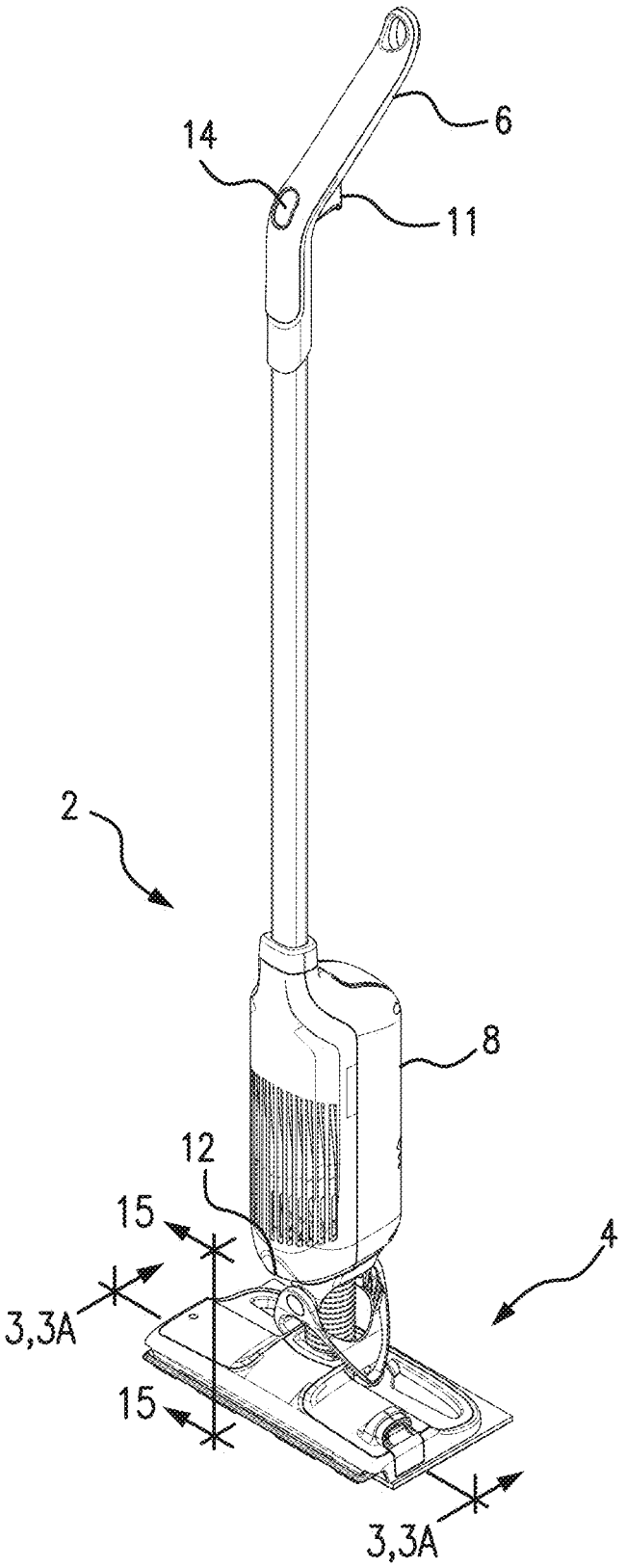
FIG. 1 shows an isometric view of a cleaning device and replacement head of the present invention.
Figure 2:
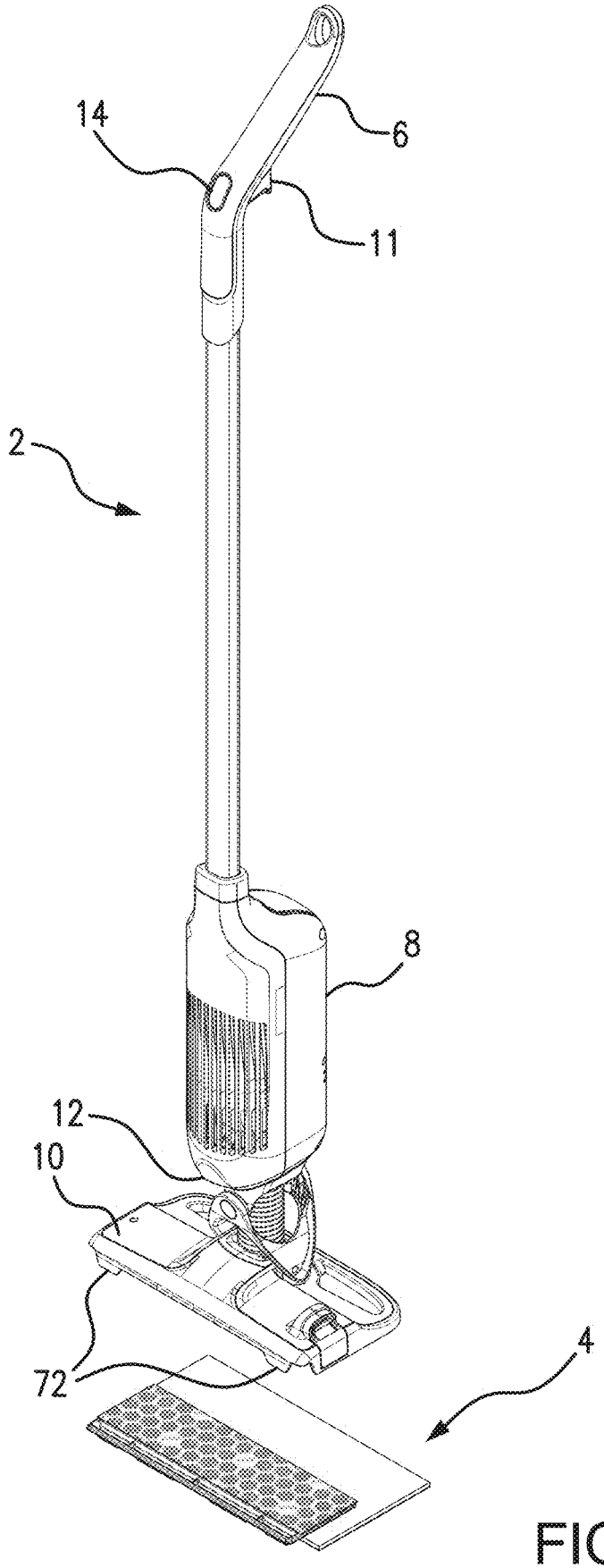
FIG. 2 shows an isometric view of the cleaning device and replacement head of FIG. 1 separated from one another.
Figure 3:
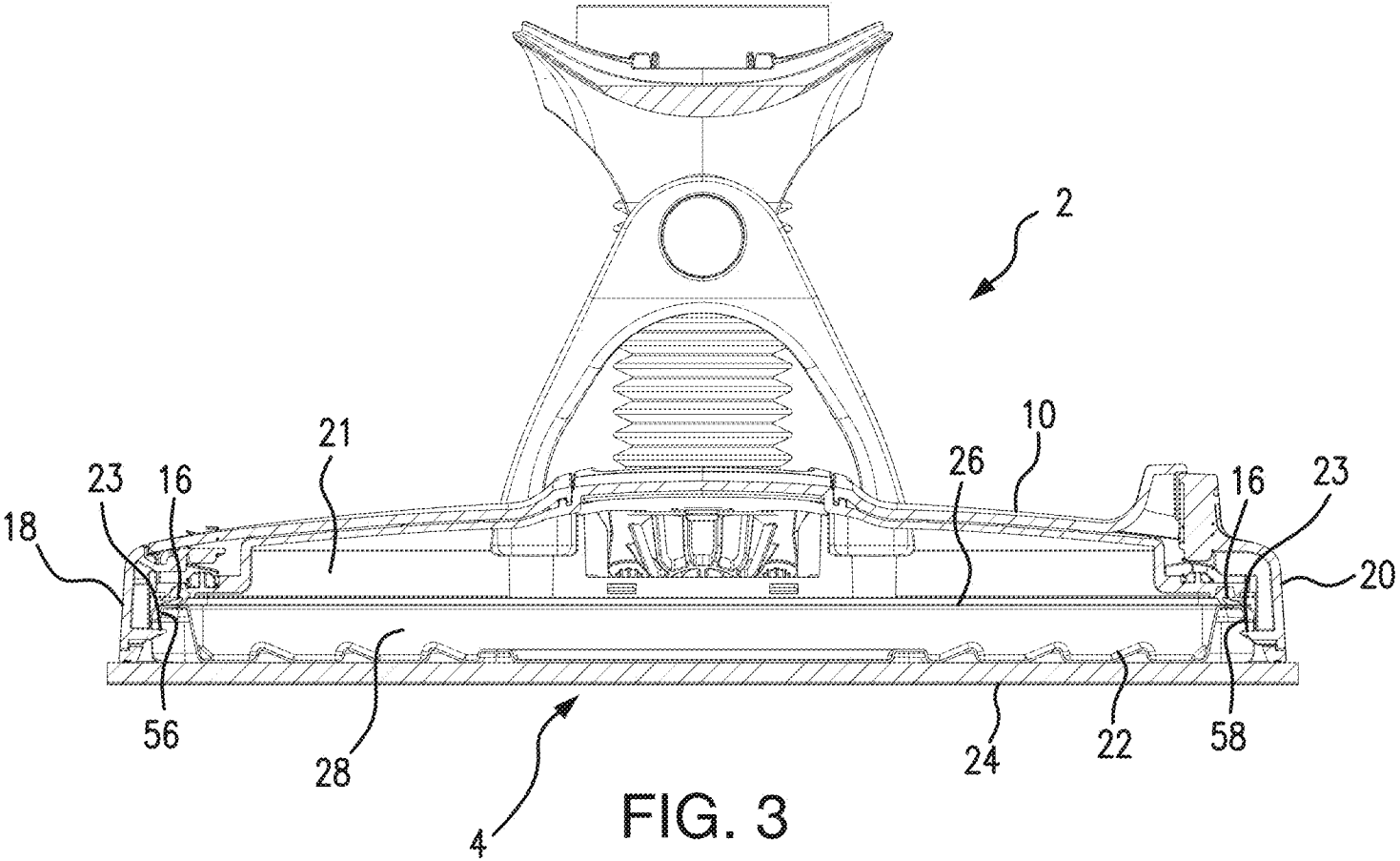
FIG. 3 shows a cross-sectional view of FIG. 1 along line 3-3 showing the cleaning device head and replacement head attached and with connector arms in the locked position.
Figure 3A:
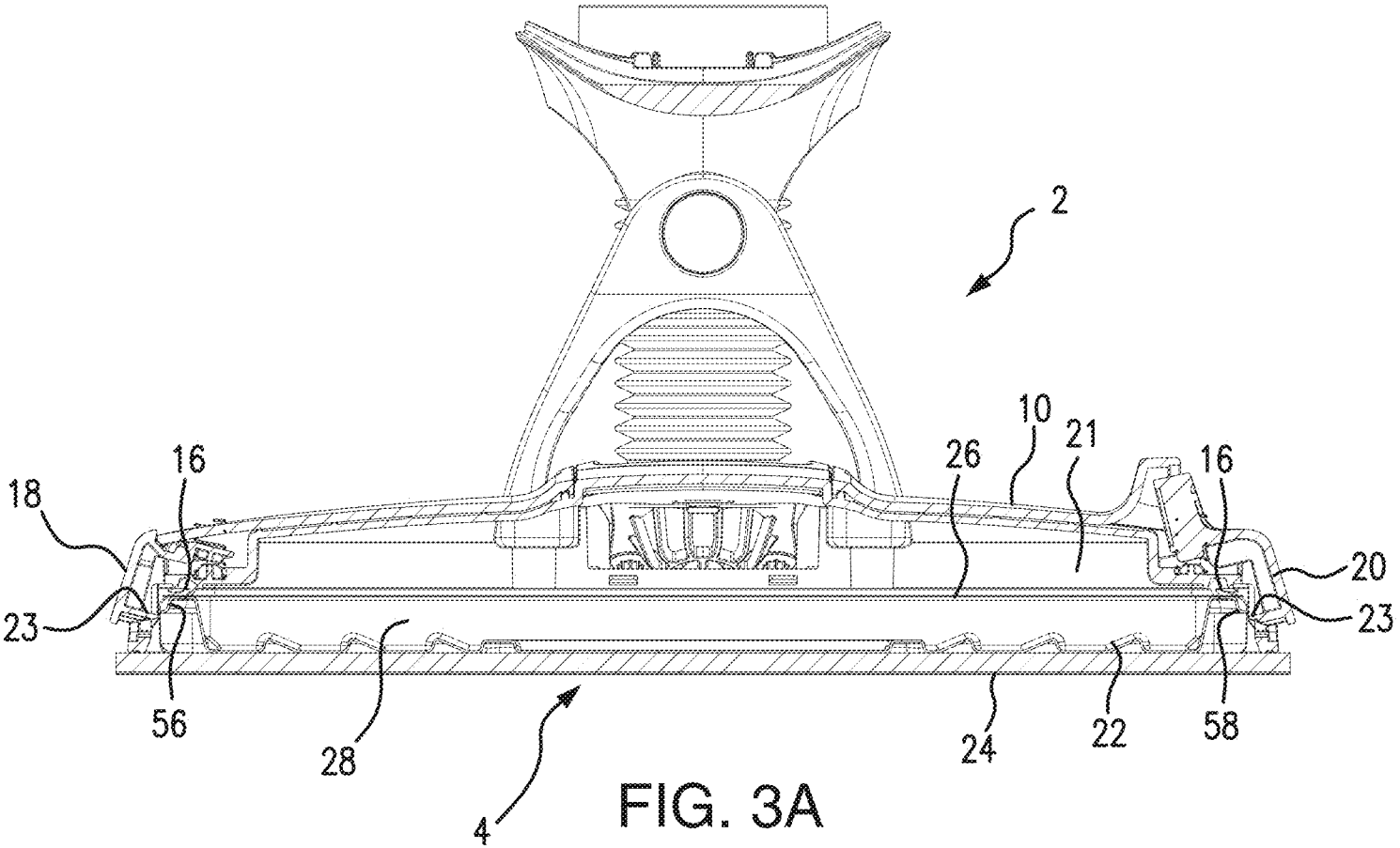
FIG. 3A shows a cross-sectional view of FIG. 1 along line 3A-3A showing the cleaning device head and replacement head attached and with a connector arm in the open position.
Figure 15:
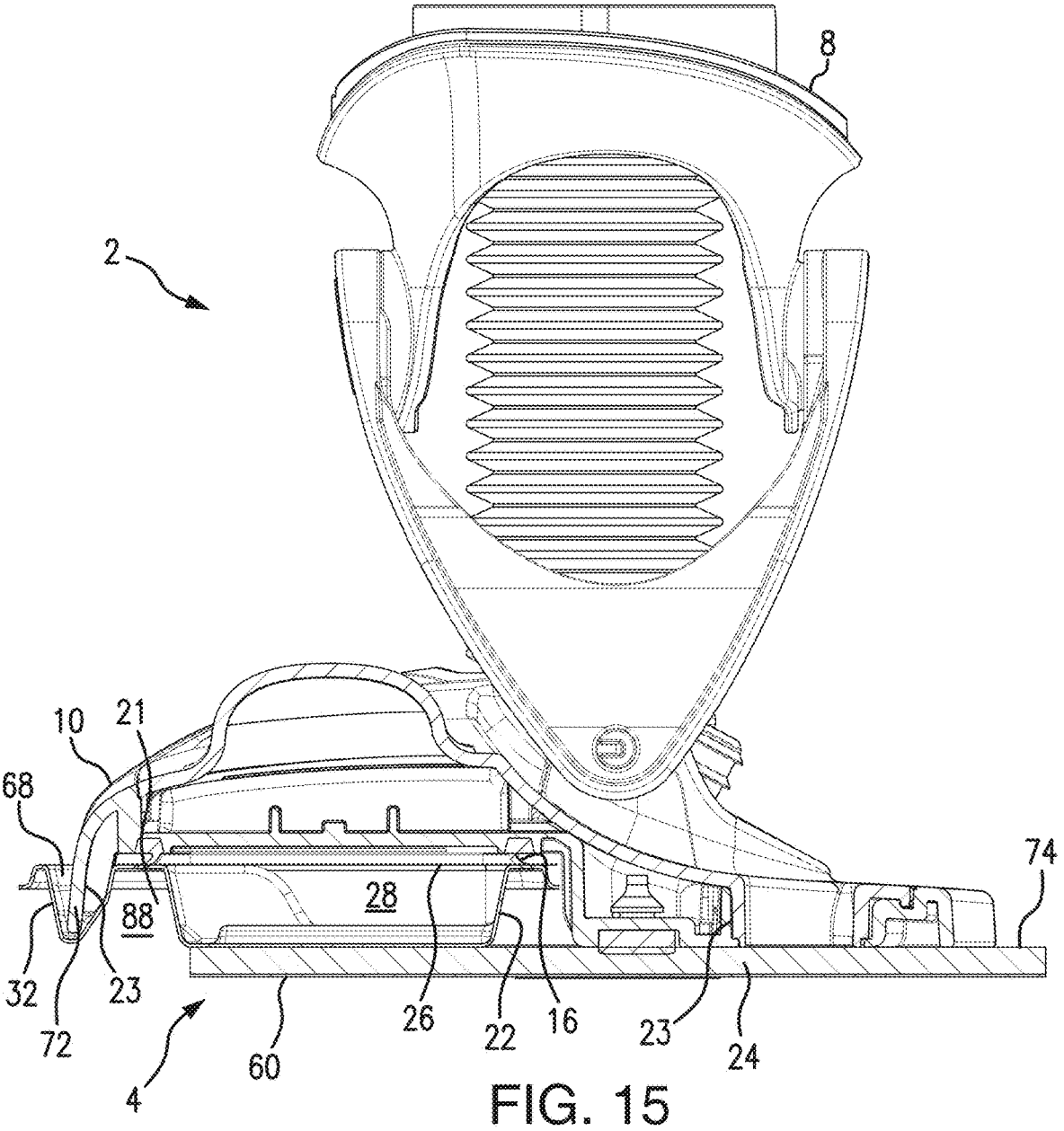
FIG. 15 shows a cross-sectional view of FIG. 1 along line 15-15 depicting the interaction between the cleaning device head and the front guard of the plastic tray.

FIGS. 1 and 2 illustrate a perspective view of a cleaning device system that includes a cleaning device 2 and a replacement head 4 that can be selectively attached and detached. The cleaning device 2 includes a handle 6, a cleaning device body 8 that optionally includes a suction source (not visible), a cleaning device head 10, and a trigger 11 for selectively activating the suction source. While the cleaning device 2 shown in, e.g., FIGS. 1 and 2 shows a combination mop and vacuum device, it should be recognized by one of skill in the art that the cleaning device 2 can alternatively be used as a mop when the suction source is either not present, or is not turned on during use. The cleaning device 2 may also include a container for holding a fluid (e.g., a cleaning fluid), a jet nozzle 12 and a user-activated button 14 to selectively spray the fluid from the jet nozzle 12. The jet nozzle 12 is preferably aimed to spray fluid from the jet nozzle 12 to a position in front of the replacement head 4 when the button 14 is activated by the user during normal use. Referring now to FIGS. 3 and 3A, the cleaning device head 10 includes a vacuum sealing surface 16 and at least two connector arms 18, 20. In the embodiment shown, at least one the connector arms 18 are movable between a closed position (FIG. 3) and an open position (FIG. 3A). The cleaning device head 10 includes a cavity 21 that facilitates connection with the replacement head 4. Referring generally to FIGS. 3A and 15, interior walls 23 at the front, rear and/or both sides are angled inward slightly. More specifically, the interior walls 23 are angled inward such that the opening to the cavity 21 is wider than at a location inward in the cavity 21.

Figure 4:
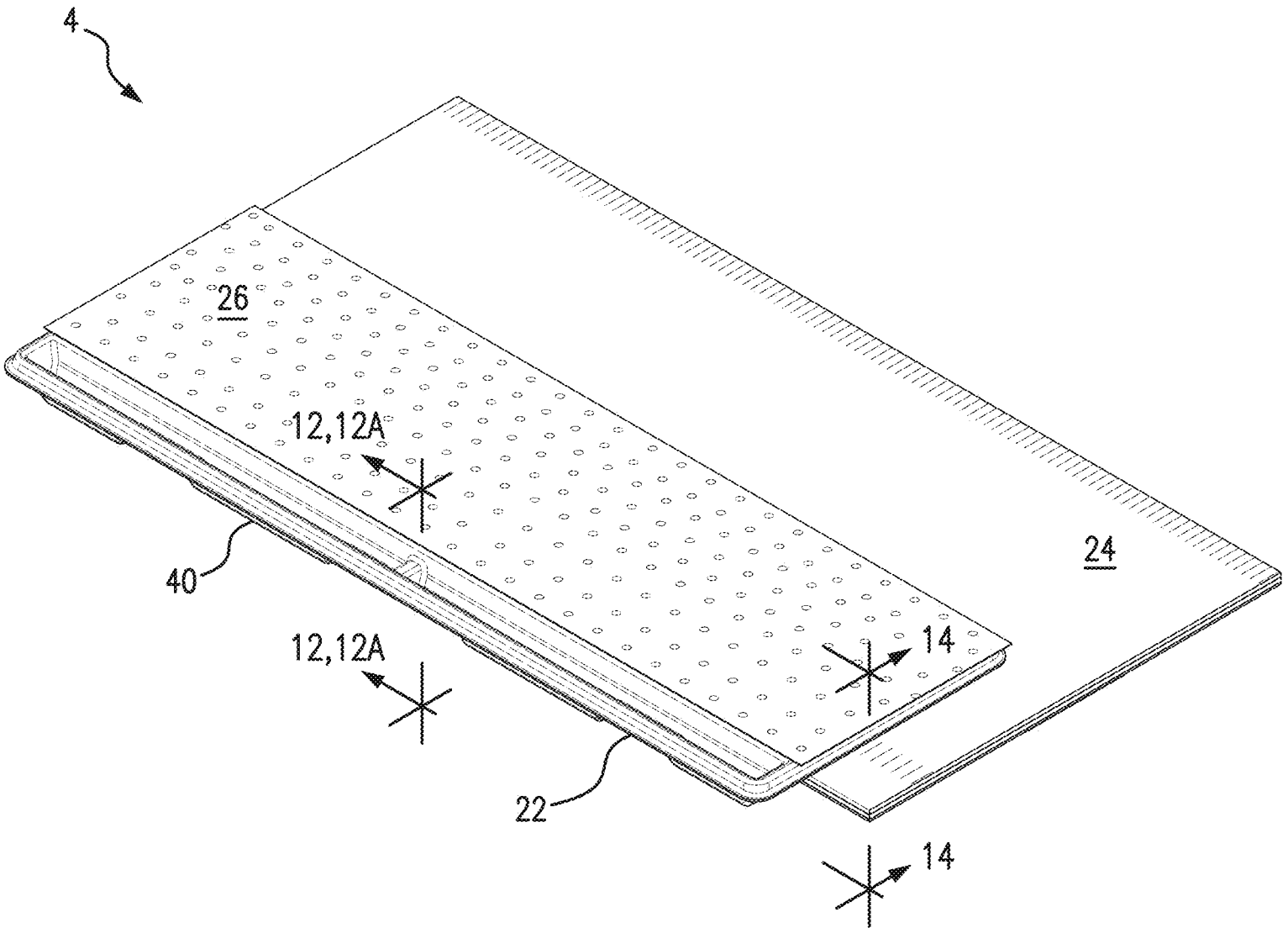
FIG. 4 shows an isometric view of the replacement head of the present invention.
Figure 5:
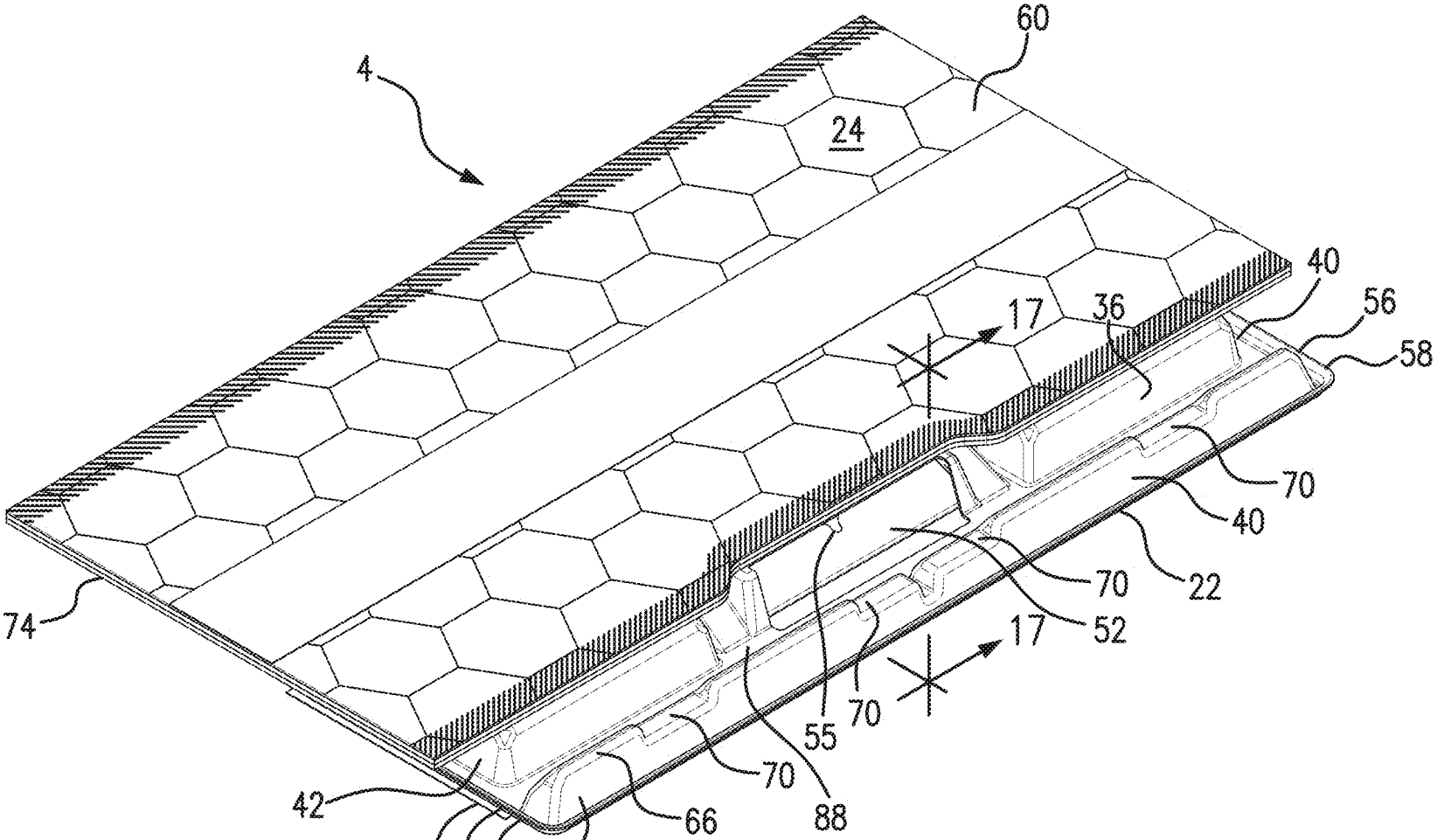
FIG. 5 shows an isometric view of the replacement head of FIG. 4 from a different angle.
Figure 6:
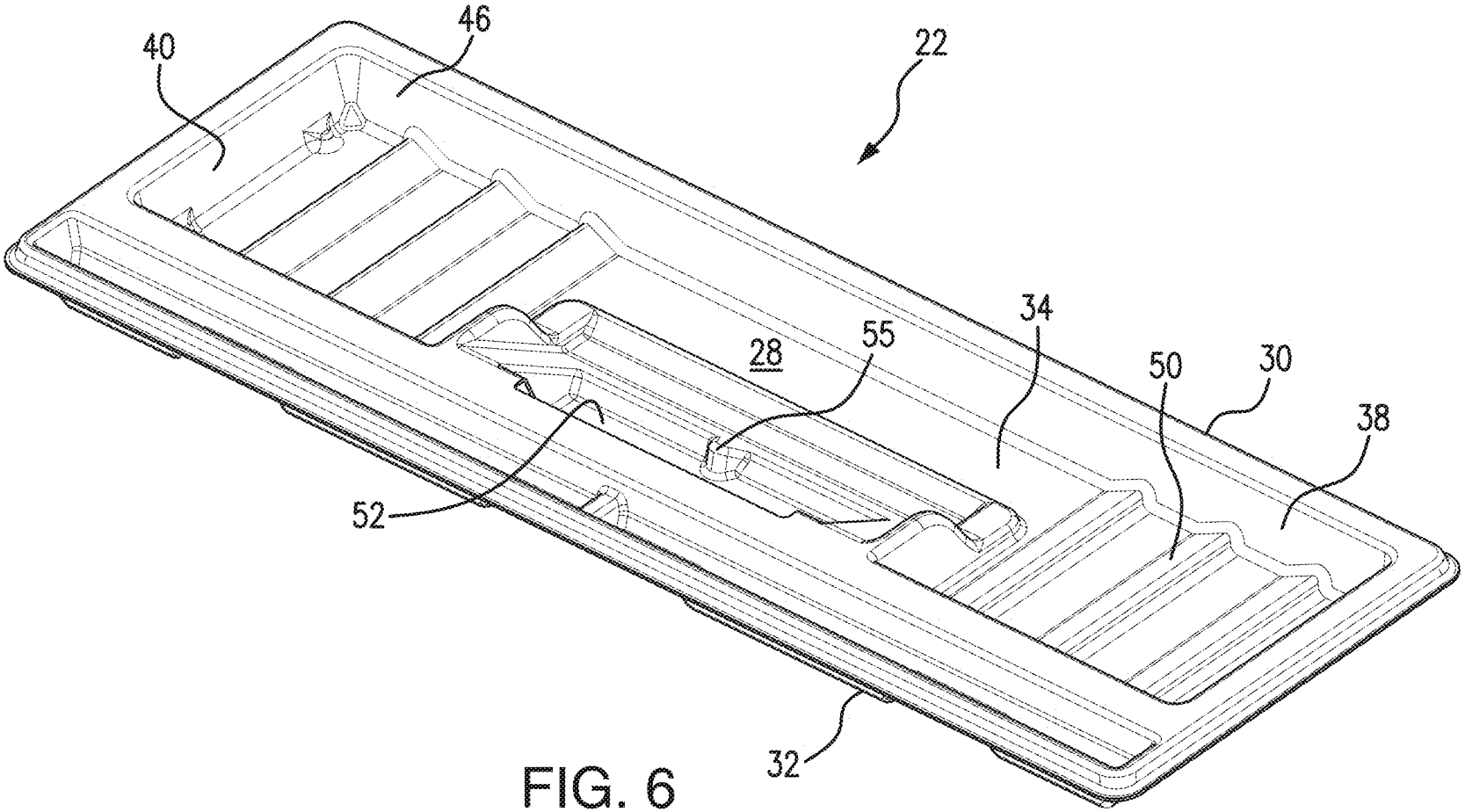
FIG. 6 shows an isometric view of the plastic tray of the present invention.
Figure 7:
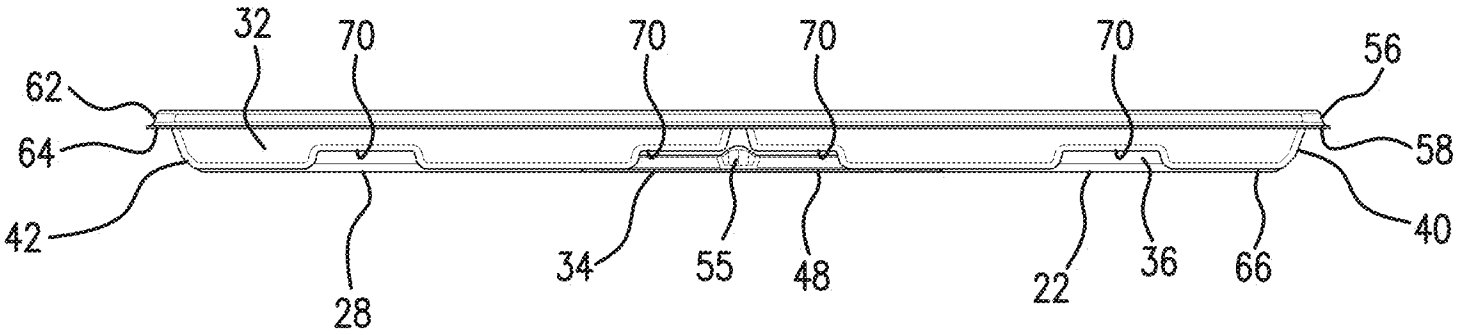
FIG. 7 shows a front view of the plastic tray of the present invention.
Figure 8:
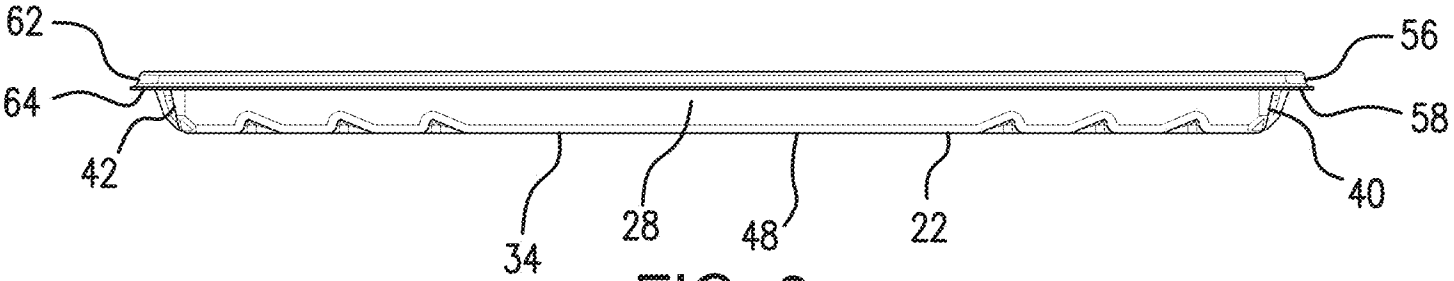
FIG. 8 shows a rear view of the plastic tray of the present invention.

Referring now to FIGS. 4-6, the replacement head 4 includes a pad 24, a filter 26, and an attachment member that, in the embodiment shown, is a plastic tray 22. The plastic tray 22 includes a dust chamber 28, a sealing surface 30 (see e.g., FIG. 6) and a front guard portion 32. The plastic tray 22 in the embodiment shown acts as an attachment member that facilitates the connection between the replacement head 4 and the cleaning device head 10.

The plastic tray 22 can be made of any suitable material (including non-plastics); however, materials that are inexpensive and readily disposable are preferred. For example, polyethylene terephthalate (or "PET") is considered a preferred material, in part, because PET is inexpensive and is readily thermoformed to the desired shape. Injection molding, blow molding or any other common manufacturing processes would also be acceptable and appropriate alternatives. As shown, the plastic tray 22 can be formed of a single, unitary piece, or can be comprised of two or more parts that are connected or joined during the assembly of the replacement head 4.

Figure 9:
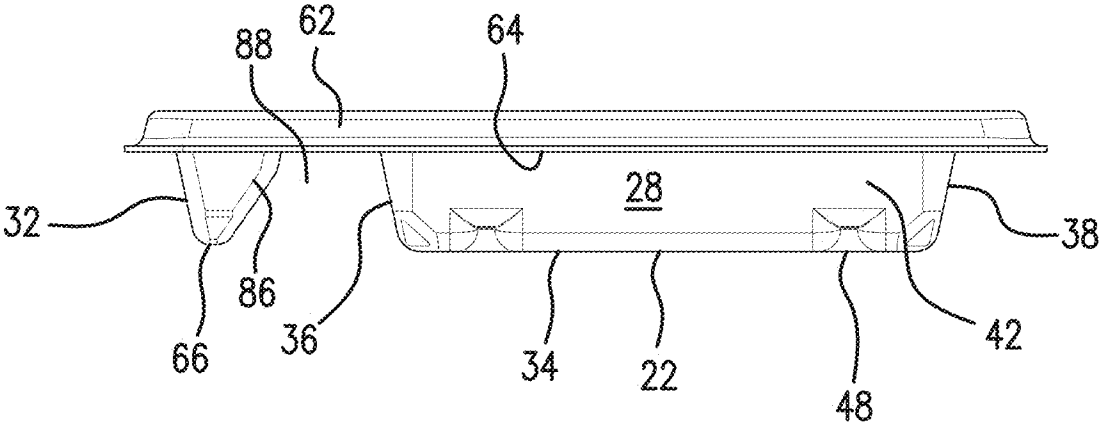
FIG. 9 shows a side view of the plastic tray of the present invention.
Figure 10:
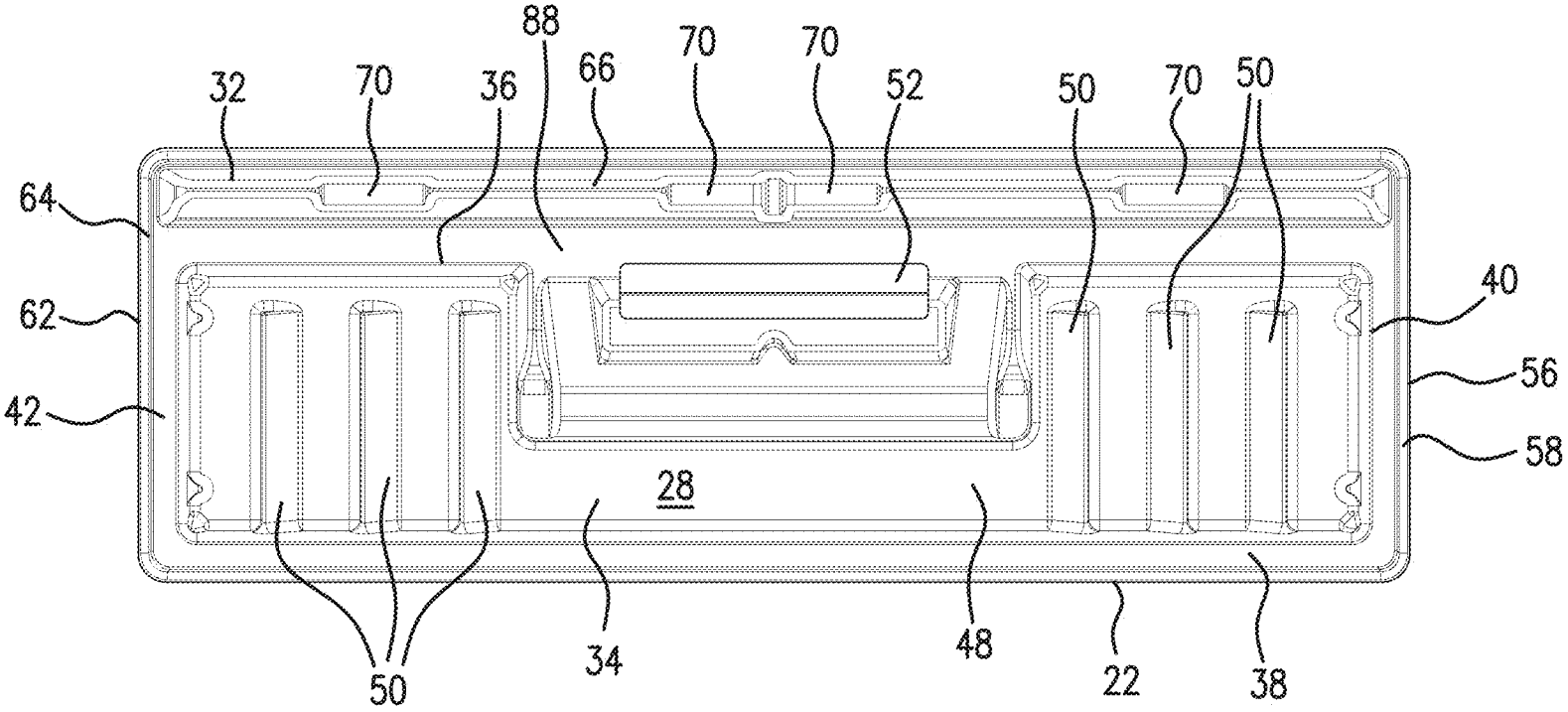
FIG. 10 shows a bottom view of the plastic tray of the present invention.

The plastic tray 22 as shown in FIGS. 6-12 includes a dust chamber 28 that is sized and shaped to collect and retain dust and debris that is suctioned into the plastic tray 22 during use. In the embodiment shown, the dust chamber 28 has a bottom wall 34, a front wall 36, a rear wall 38, a left wall 40, and a right wall 42. At the top of the dust chamber 28 is a top opening 46. Together, the walls and the top opening 46 generally define a volume of space capable of collecting and retaining common household dust and debris. One of skill in the art would understand that varying the size and shape of the walls and top opening 46 would increase or decrease the overall volume of the dust chamber without departing from the spirit of the invention. Although the rear wall 38, and left and right walls 40, 42 are shown as generally straight in FIGS. 9 and 10, the walls can include at least one curve or a bend, or include other features that make them not straight. For example, the front wall 36, as shown in FIG. 10, includes a series of curves and features. The curves and bends, among other benefits, increase the structural stability without increasing the thickness of the material. The bottom wall 34 defines a bottom surface 48 and may include ridges 50 (see FIGS. 8 and 10) to assist with retaining dust in place that has collected at the bottom of the dust chamber 28 during use. Alternatively, the bottom wall 34 can be generally flat.

Referencing now to FIGS. 3, 3A, 6 and 11, a sealing surface 30 extends circumferentially around the top opening 46 of the plastic tray 28. The sealing surface 30 is complementary to a vacuum sealing surface 16 on the cleaning device head 10. The sealing surface 30 and the vacuum sealing surface 16 are either directly or (preferably) indirectly in contact with one another during use. In a preferred embodiment, where the sealing surface 30 and the vacuum surface 16 are indirectly in contact, the filter 26 may be sandwiched therebetween during use (see e.g., FIG. 3). To facilitate an effective seal that prevents a loss of suction during use, the sealing surface must be held in place with sufficient enough force against the vacuum sealing surface. In the embodiment shown, the sealing surface is a generally rectangular ring with a generally flat surface. The term generally rectangular is intended to describe a shape with a width greater than a length. However, the shape is not intended to be limited to a precise rectangle. For example, as shown in e.g., FIG. 10, the generally rectangular shape includes corners that are rounded. Other embodiments could have chamfered corners, or non-straight sidewalls.

Figure 11:
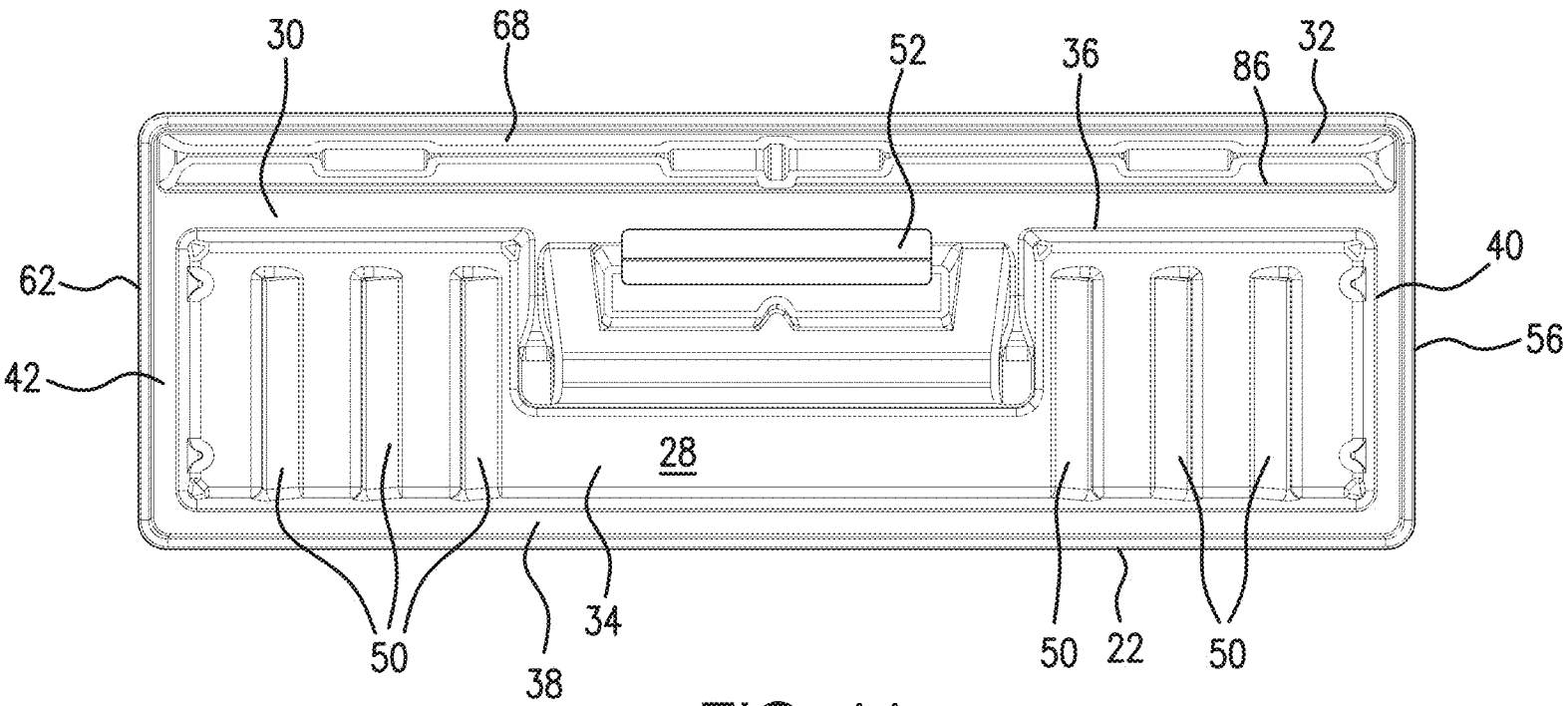
FIG. 11 shows a top view of the plastic tray of the present invention.

Referring to FIGS. 5, 10 and 11, at least one opening 52 exists that enables air, dust and debris to be drawn in from a position outside the replacement head 4 into the dust chamber 28 during use. In a preferred embodiment, a single rectangular-shaped opening 52 is located on the front wall 36 of the dust chamber 28. One of skill in the art would understand that alternative embodiments, although not shown, could include: multiple openings on a single wall; an opening that extends over two or more adjacent walls; at least opening on one wall, and another opening on another wall; or any combination of the above alternatives.

The opening 52 is preferably covered by an opening cover 54. The opening cover 54 can be made of any suitable material; however, in two preferred embodiments the material is either spunbond polypropylene, 1.25 oz and extruded PET, 0.7 Mil or 80 gsm spunbond PP. Preferably, the opening cover 54 is a cantilevered flap that, when open (FIG. 12A), permits air, dust and debris to enter into the dust chamber and, when closed (FIG. 12), generally covers the opening 52 to retain collected dust and debris within the dust chamber 28. While the cantilevered flap described above is a cost-effective solution, alternatives can include, for example, an opening cover 54 that is made of plastic or metal. The opening cover 54 is, preferably, attached to the underside of the filter 26. However, although not shown, the opening cover 54 can, for example, be attached to the plastic tray. In addition, while the preferred embodiment generally relies on the flexibility and resiliency of the opening cover 54 material employed, the opening cover 54 can also employ a hinge that defines a pivot axis, or a living hinge.

In some embodiment, and now referring FIG. 5, the opening may further include an opening rib 55. The opening rib 55 is preferably integral with the dust chamber 28 and provides a stop surface to prevent the opening cover 54 from becoming either stuck in the opening 52 or from exiting the opening 52 during either shipment or normal use.

Figure 13:
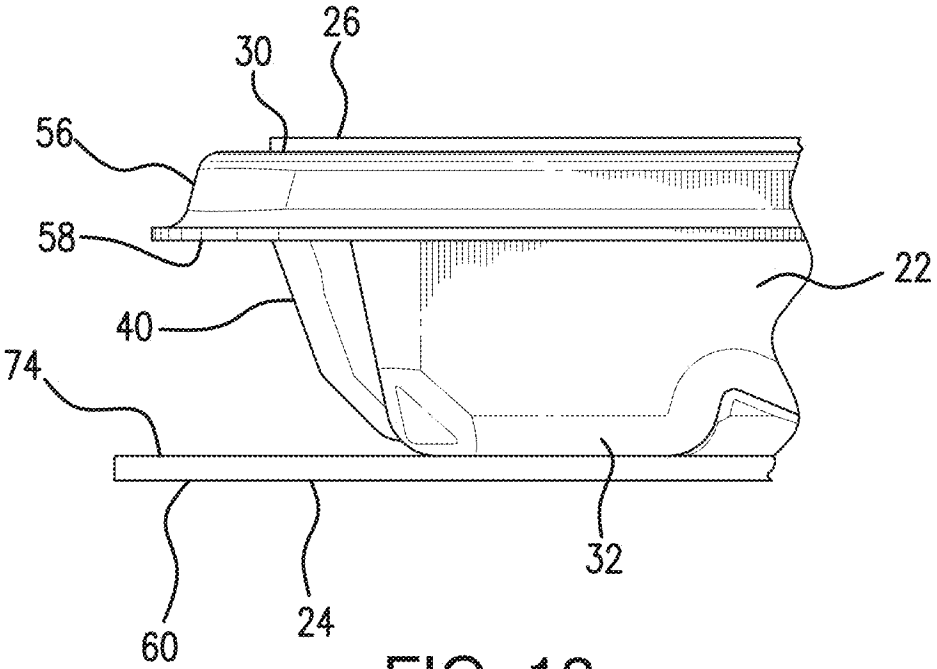
FIG. 13 shows an enlarged front view of one side of the replacement head.
Figure 14:
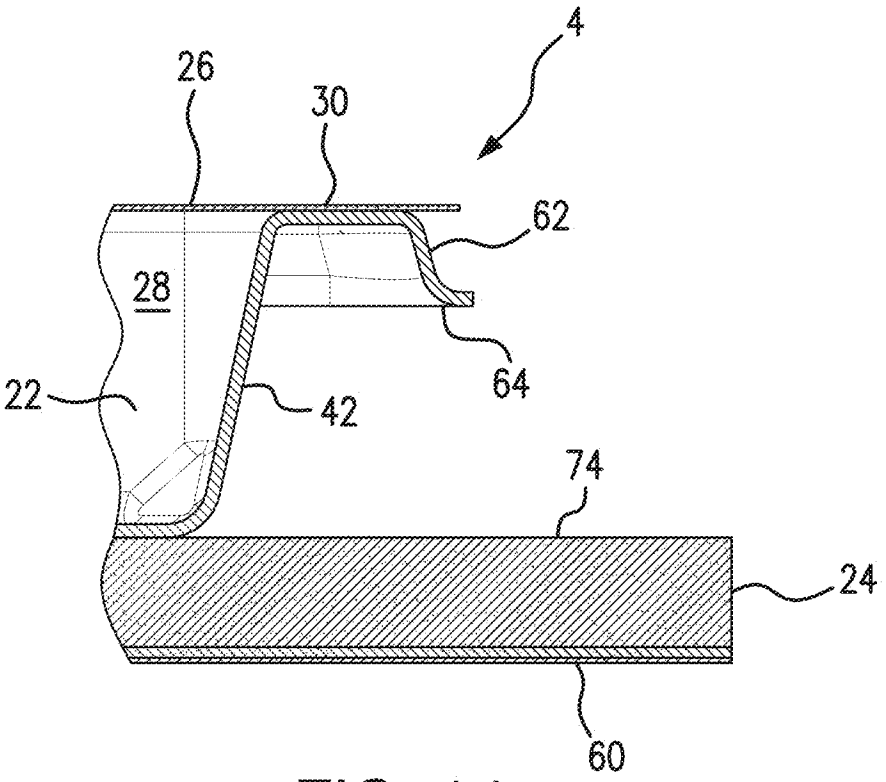
FIG. 14 shows a cross-sectional view of FIG. 4 along line 14-14 depicting the shape of the first connector lip.

Referring to FIGS. 7-11 and 13, the plastic tray 22 acts as the attachment member for the replacement head 4. The plastic tray 22 includes a first connector lip 56 that extends outwards from the left wall 40 of the dust chamber 28, outside of the sealing surface 30. Also, at least a portion of the first connector lip 56 is located between the front wall 36 and the rear wall 38 of the dust chamber, as shown, e.g., in FIG. 11. The first connector lip 56 includes a lower surface 58 that is located below the sealing surface 30. More particularly, and as shown in FIGS. 13 and 14, the lower surface 58 of the first connector lip 56 is located between the level of the sealing surface 30 and the second surface 60 of the pad 24 (described in greater detail below). Even more particularly, the lower surface 58 of the first connector lip 56, in some embodiments, is closer to the sealing surface 30 than the second surface 60 of the pad 24. The cross-sectional shape of the first connector lip 56 may be of any chosen by the designer. However, it is preferred, in order to increase rigidity and reduce material, that the first connector lip 56 has a cross-sectional shape that includes at least one curve. The actual relative positioning of the lower surface 58 of the first connector lip 56 should be complementary to the design of the of the cleaning device head 10 and connector arms 18, 20. In the locked position, as shown in FIG. 3, the connector arms 18, 20 of the cleaning device head 10 engage with the lower surface 58 of the first connector lip 56. When held in position by the connector arms 18, 20 of the cleaning device head 10, the sealing surface 30 of the replacement head 4 is engaged with, either directly or indirectly, vacuum sealing surface 16.

In some embodiments, and now referring to FIGS. 10 and 11, the first connector lip 56 may extend rearward of the rear wall 38 and/or further forward of the front wall 36. In even further embodiments, the first connector lip 56 may extend forward of the front guard 32 (described below). The first connector lip 56 may be formed integrally with the other features of the plastic tray 22 (e.g., the dust chamber), or may be a separate element that is combined with the remaining features of the plastic tray 22 prior to end use.

Referring to FIGS. 7-11 and 13, the second connector lip 62 extends outwards from the right wall 42 of the dust chamber 28, outside of the sealing surface 30. Also, at least a portion of the second connector lip 62 is located between the front wall 36 and the rear wall 38 of the dust chamber 28, as shown, e.g., in FIGS. 10 and 11. Similar to the first connector lip 56 shown in FIGS. 13 and 14, the second connector lip 62 includes a lower surface 64 that is located below the level of the sealing surface 30 (see e.g., FIGS. 7 and 8). More particularly, the lower surface 64 of the second connector lip 62 is located between the level of the sealing surface 30 and the second surface 60 of the pad 24 (described in greater detail below). Even more particularly, the lower surface 64 of the second connector lip 62, in some embodiments, is closer to the sealing surface 30 than the second surface 60 of the pad 24. The cross-sectional shape of the second connector lip 62 may be of any chosen by the designer and may be the same as, or different than, the first connector lip 56. It is preferred that the second connector lip 62, for the same reasons stated above, has a cross-sectional shape that includes at least one curve. The relative positioning of the lower surface 64 of the second connector lip 62 should be set such that it is complementary to the design of the of the cleaning device head 10 and connector arms 18, 20. In the locked position, as shown in FIG. 3, the connector arms 18, 20 of the cleaning device head 10 engage with the lower surface 64 of the first connector lip 56. When held in position by the connector arms 18, 20 of the cleaning device head 10, the sealing surface 30 of the replacement head 4 is engaged with, either directly or indirectly, vacuum sealing surface 16.

In some embodiments, and now referring to FIGS. 10 and 11, the second connector lip 62 may extend rearward of the rear wall 38 and/or further forward of the front wall 36. In even further embodiments, the second connector lip 62 may extend forward of the front guard 32 (described below). The second connector lip 62 may be formed integrally with the other features of the plastic tray 22 (e.g., the dust chamber 28), or may be a separate element that is combined with the remaining features of the plastic tray 28 prior to end use. In some embodiments, the first and second connector lips 56, 62 may be separate elements while, in other embodiments, such as the embodiment shown in, e.g., FIG. 6, the first and second connector lips 56, 62 may be interconnected across the front and/or rear of the plastic tray 22.

Referring now to FIGS. 5, 7, 9 and 10, the plastic tray 22 can include a front guard portion 32 that is located at least partially forward of the dust chamber 28. In the embodiment shown, the front guard portion 32 is located forward of the dust chamber 28 and defines a shaped bottom surface 66 and an interior space 68 and extends generally from the right side of the plastic tray 22 to left side. The cross-sectional shape of the front guard 32 can be any suitable shape; however, a generally triangular cross-section (as shown in FIG. 9) has been shown to have particular utility. The lowest portion of the bottom surface 66 is preferably in close proximity to the floor being cleaned to assist in controlling the airflow into the dust chamber 28. In some embodiments, as shown in, e.g., FIGS. 5 and 7, it is preferable that the front guard 32 includes one or more castellations 70. While it is desirable for sections of the front guard 32 to be in close proximity to the ground during the cleaning process, the castellations 70 provide sections that permit larger pieces of debris (e.g., pieces of cereal) to come into close proximity to the opening 52 of the dust chamber 28 in order to be drawn into the dust chamber 28. The interior space 68 of the front guard 32, as shown in FIG. 11, provides space to receive corresponding, complementary features 72 on the cleaning device head 10. Preferably, the interior space 68 is located at an asymmetrical location on the plastic tray 22 such that, if the replacement head 4 were to be unintentionally reversed by the end user, the features on the front of the cleaning device head 10 would contact plastic tray material (e.g., the sealing ring 30), thus cueing the end user that the replacement head 4 is being attached incorrectly. The cleaning device head 10 may include a single feature that enters the interior space 68 of the front guard 32 during attachment, or, as shown in FIG. 3, may include multiple features. As noted above, the interior space 68 may be generally triangular in shape. In these embodiments, the generally converging walls of the interior space 68 function to assist the user to position the cleaning device head 10 into the proper attachment position by urging the cleaning device head 10 either slightly forwards or backwards during attachment.

Referring now to FIG. 9, the interior space 68 may have a partial vertical wall 86 on the side closer to the dust chamber 28. The partial vertical wall 86 can interact with features on the cleaning device head 10 to prevent motion relative to the cleaning device head 10 during a pull-back stroke.

Located between the front guard portion 32 and the dust chamber 28 is the front suction chamber 88. The front suction chamber 88 extends across the plastic tray 22 from side to side. The front suction chamber 88, as shown in FIG. 9, is bounded on the front by the rear side of the front guard portion 32 and at the rear by the front wall 36 of the dust chamber and the opening 52. The size and shape can be determined by the designer; however, it is preferable to shape the front suction chamber 88 in such a manner to encourage airflow to direct dust, dirt towards the opening(s) 52.

The filter 26 is made of a suitable material that will permit air to pass therethrough during use, yet block at least a substantial portion of the dust that is drawn into the dust chamber 28 during cleaning. In addition, it is desirable for the filter 26 to have the ability to absorb and/or block moisture prior to entering the cleaning device 2. It is desirable to choose a material that is inexpensive to manufacture, readily cut to size and easily attachable to the plastic tray 22. In the embodiment shown, the filter 26 is a non-woven, hydrophobic material made of SMS Polypropylene, 40 gsm. In embodiments where the filter material is printable, an additional printed pattern may appear on the filter 26 that includes, e.g., a logo or directions for use.

The filter 26 is attached to the plastic tray 22 such that substantially the entire top opening 46 is covered, as shown in FIG. 4. It is desirable that most, if not all, of the air that is drawn into the dust chamber 28 during vacuuming passes through the filter 26 prior to entering the cleaning device 2 so that the amount of dust, debris and moisture that enters into, and therefore can potentially damage, the suction source is minimized. The embodiment shown in FIG. 3, the filter 26 is attached to the sealing surface 30 such that, when the replacement head 4 is attached to the cleaning device head 10, the filter 26 is sandwiched between the sealing surface 30 of the plastic tray 22 and the vacuum sealing surface 16. While it is desirable for the filter 26 to cover substantially all of the top opening 46 of the dust chamber 28, it is preferable that the filter 26 does not cover interior space 68 of the front guard 32 so that features 72 on the cleaning device head 10 can enter into the interior space 68 of the front guard 32 unimpeded during attachment. The filter 26 may be attached to the plastic tray 22 in any acceptable manner. Suitable methods include using heat to bond the materials together, as well as the use of glues and adhesives. While it is preferable that the filter 26 is attached in a permanent manner to the plastic tray 22, other embodiments can have a removable connection. Even further embodiments can include an end user placing the filter 26 over the top opening 46 during use.

Figure 16:
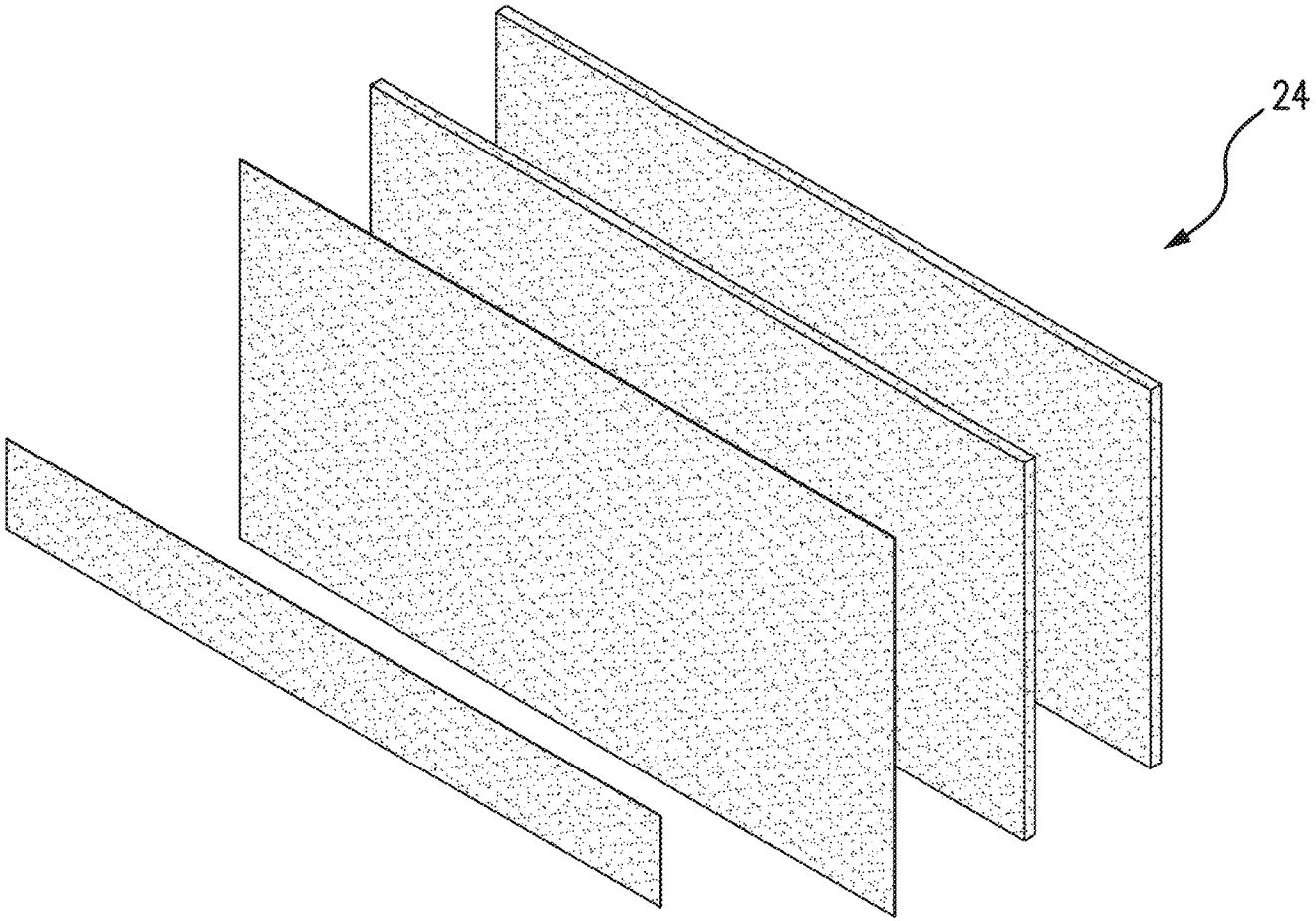
FIG. 16 shows an exploded view of one embodiment of the pad of the present invention.

The pad 24 includes a first surface 74 and a second surface 60 and is made from any suitable material that, preferably, can be used to scrub the surface being cleaned and/or absorb moisture. Pads 24 are well-known in the art and can include one or more layers. For example, a pad with a single layer made of 100% PET material or Carded Spunlace PET, 58 gsm; Spunbond PP, 10 gsm may be used. Or, as shown in FIG. 16, the pad 24 can include, e.g., four layers that each provide utility (e.g., absorption, retention, scrubbing). Exemplary layers include:

Layer 1: Air Laid Retention Layer; 180 gsm, 47% Pulp, 53% Bico

Layer 2: Air Laid Acquisition Layer; 100 gsm, 47% Pulp, 53% Bico

Layer 3: Face Layer; Carded Spunlace PET, 58 gsm; Spunbond PP, 10 gsm

Layer 4: Multi-function Strip; Melt Blown PP, 35 gsm

Referring to FIGS. 4 and 5, a multi-layer pad 24 is shown. In order to bond the various layers together, multiple methods are shown. In FIG. 5, the layers are ultrasonically welded together in a continuous manner along the entire edge. In certain embodiments, additional welds can be made in the body of the filter, as shown in a generally hexagonal pattern in FIG. 5. The continuous weld along the front and rear edges tends to provide a suitable bond between the layers to prevent delaminating. In FIG. 4, tack welding at localized positions along the front and rear edges is shown. In some embodiments, a total of about eight (8) weld locations are provided. In other embodiments, using approximately about fifty (50) weld locations has been found to work suitably well. In addition, and still referring to FIG. 4, the spaced apart weld locations may be positioned along the edge of the pad 24. In other embodiments, as shown along the front edge of the pad in FIG. 4, the weld locations may be set back. By welding the layers together in localized positions, it has been shown that the welds maintain acceptable attachment between the layers, but allow for some expansion therebetween. The expansion between the welds has been found to permit additional absorption of liquids during use. For example, in some instances, where a continuously welded multi-layer pad might tend to push an amount of water that is on the floor either in front of or behind the cleaning device 2, an intermittently welded pad may absorb the liquid due to slight delamination that can occur between the welds. In embodiments where the welds are set back from the edge of the pad 24, localized delamination can be increased and, in certain circumstances, result in increased performance. The number of welds and location of the welds between the front and rear of the pad 24 can be the same, or different depending on the discretion of the designer.

The outer shape of the pad 24 can be any suitable known to one of skill in the art. As shown in FIG. 5, the pad 24 can be generally rectangular. The first surface 74 of the pad 24 is attached to the bottom surface 48 of the dust chamber 28 such that the second surface 60 of the pad 24 material is in contact with the floor during cleaning. Preferably, the first surface 74 of the pad 24 covers at least most of the bottom surface 48 of the dust chamber 28 and, even more preferably, covers the entirety. The pad 24 may extend outward from the bottom surface 48 of the dust chamber 28. As shown in FIGS. 4 and 5, the pad 24 extends rearward and to the sides of the bottom surface 48 of the plastic tray 28. Although it is acceptable for the pad 24 to extend forward of the front wall 36 of the dust chamber 28, such an arrangement has the potential to hinder usability by, e.g., blocking the opening 52 to the dust chamber 28 and/or the potentially causing the pad 24 to fold or buckle when the cleaning device 2 is pushed forward by the user during cleaning.

The pad 24 can be attached in any suitable manner. Preferably, the first surface 74 of the pad 24 is attached to the bottom surface 66 of the dust chamber 28 in a permanent manner. Suitable methods include using heat bonding or adhesives. Alternatively, the pad 24 can be replaceable and attached in a removable manner by, e.g., hook and loop fasteners.

Figure 17:
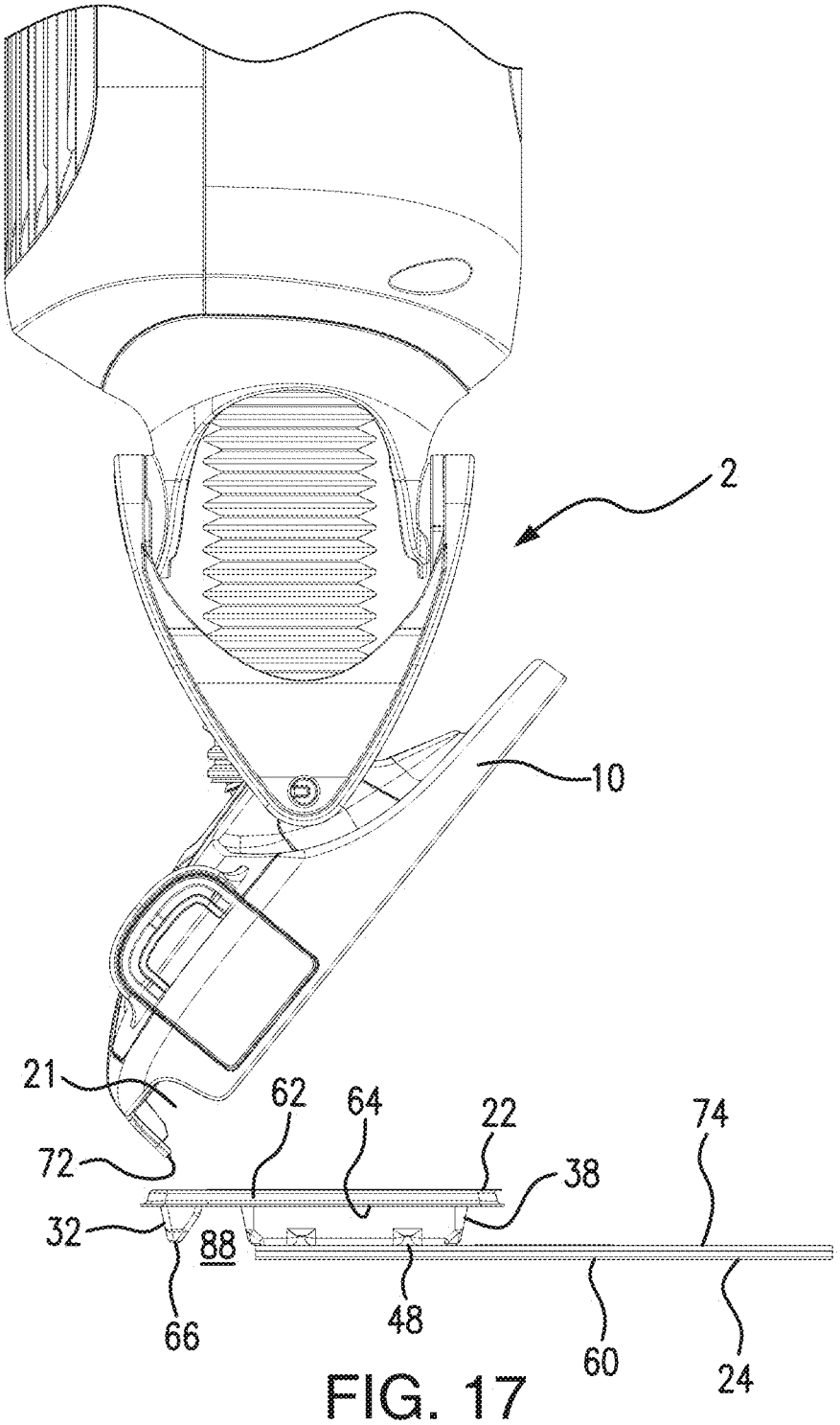
FIG. 17 shows a cleaning device being lowered towards a replacement head of the present invention during the connection process.
Figure 18:
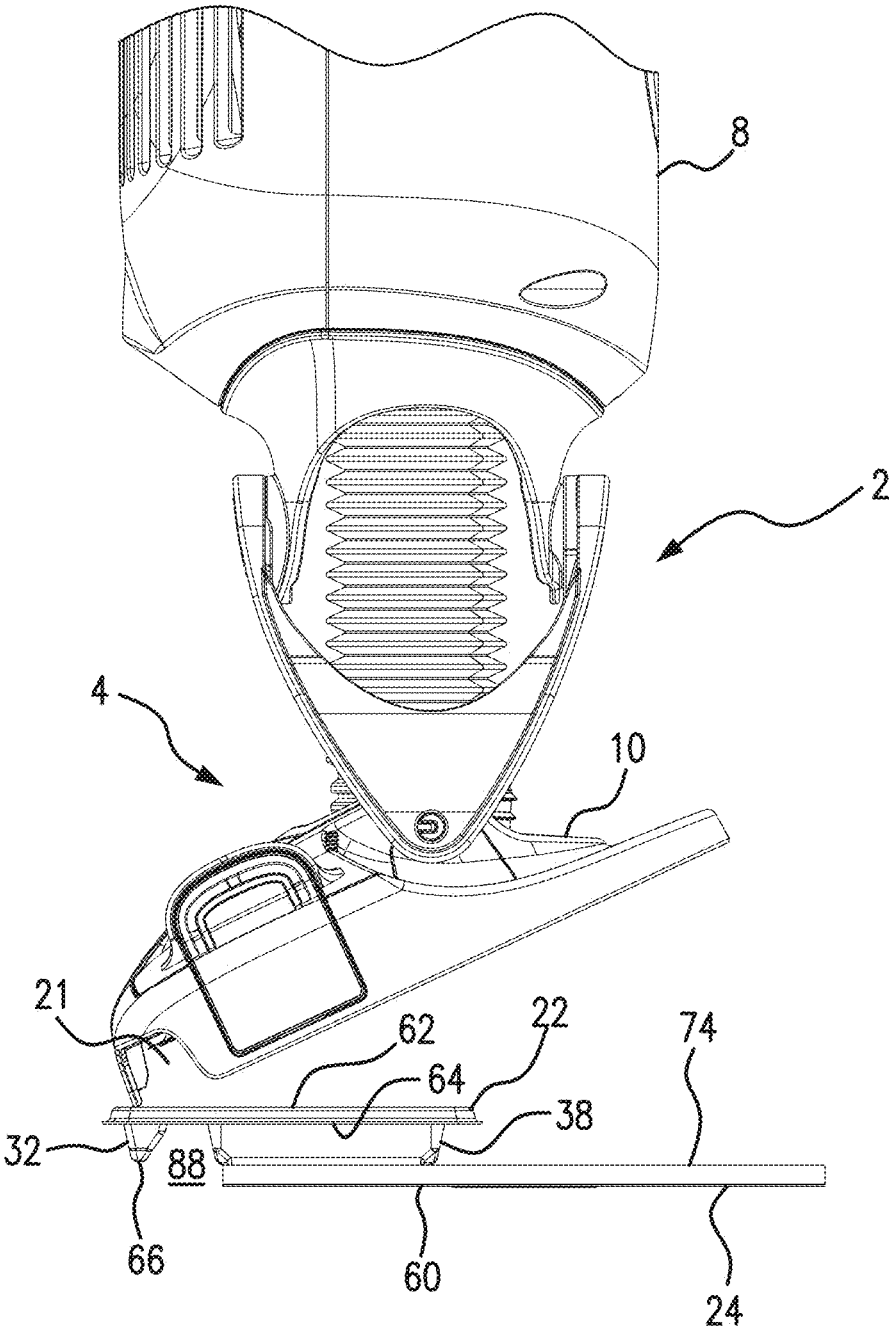
FIG. 18 shows the cleaning device and replacement head of FIG. 20 slightly closer to each other during the connection process.
Figure 19:
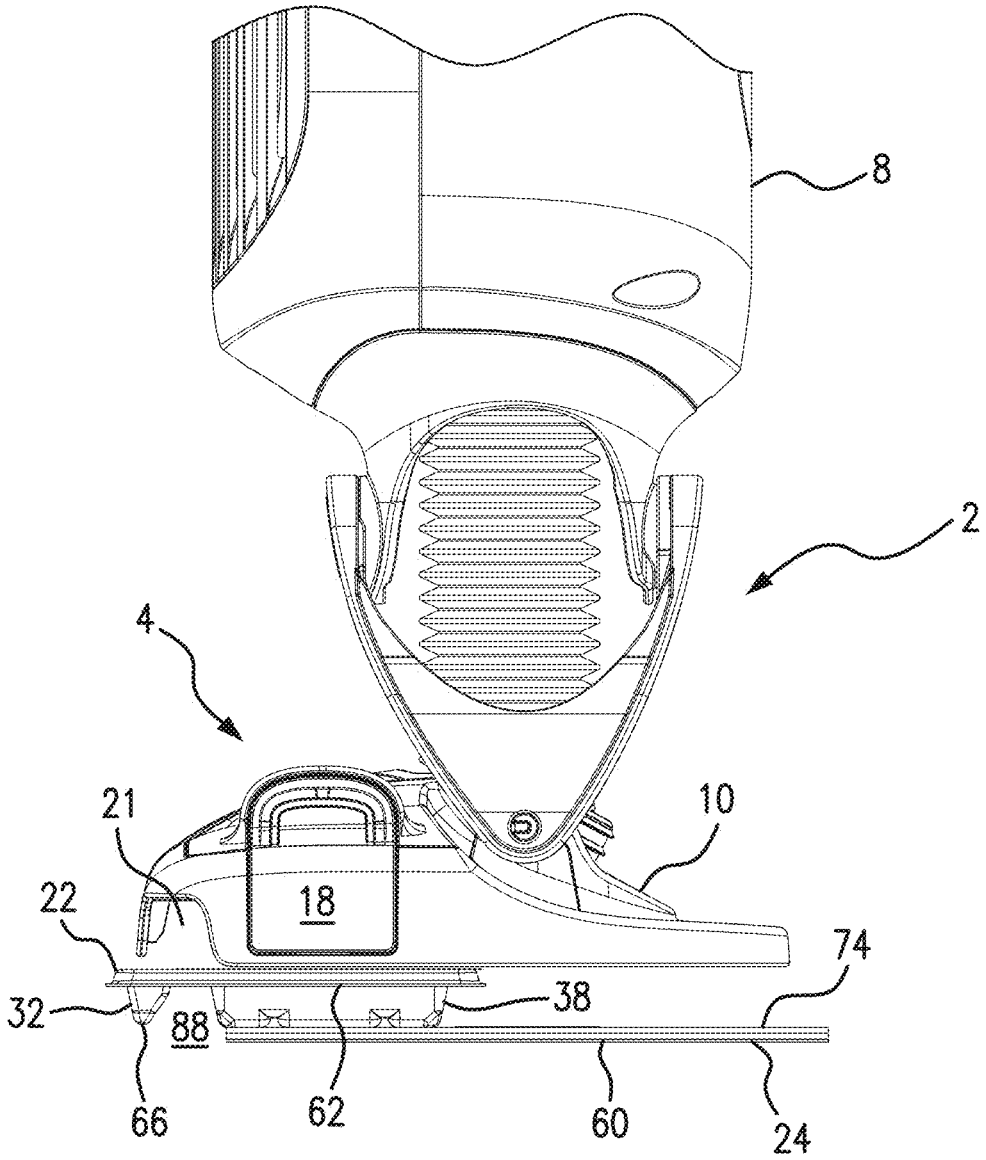
FIG. 19 shows the cleaning device and replacement head of FIGS. 20 and 21 even closer to each other during the connection process.
Figure 20:
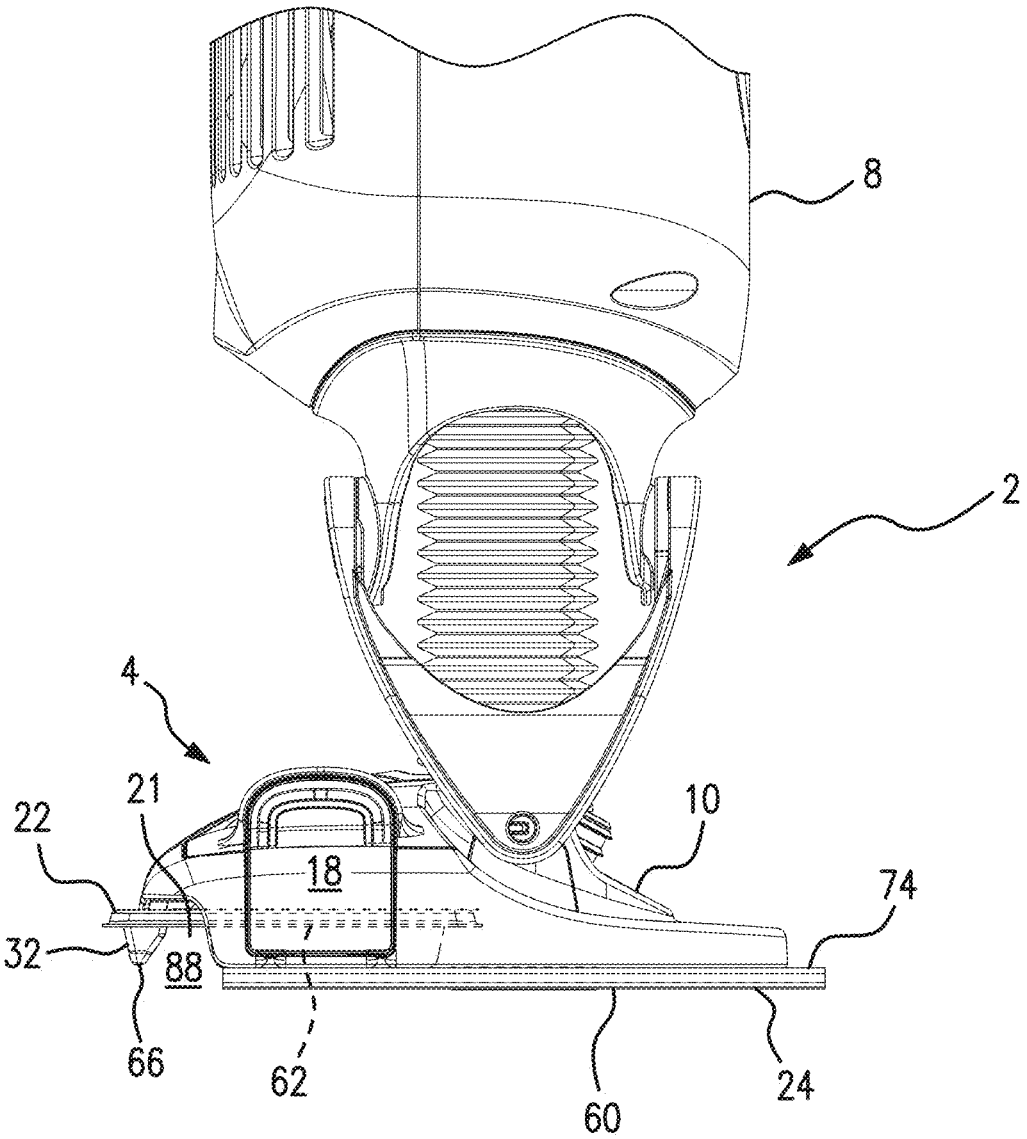
FIG. 20 shows the cleaning device and replacement head of FIG. 20 after the connection process has been completed.

Referring now to FIGS. 17-20, one method of attaching the replacement head 4 to the cleaning device 2 is disclosed. The replacement head 4 is set on a generally horizontal surface, such as the floor, such that the second surface 60 of the pad 24 is also generally horizontal. With the cleaning device body 8 and the elongated handle 6 (see e.g. FIG. 1) held in a generally vertical manner, the user lowers the cleaning device body 8 in a vertically downward motion from directly above the replacement head 4 such that known connection features are generally aligned. Referring to FIG. 17, in some embodiments, the angle of the cleaning device head 10 relative to the remainder of elements of the cleaning device 2 may be naturally angled. However, as the user moves the cleaning device body 8 further vertically downward, the cleaning device head 10 contacts the replacement head 4 and the cleaning device head 10 naturally rotates such that the lower surface also becomes horizontal relative to the floor (see FIGS. 18 and 19). Referring now to FIGS. 19 and 20, as the user continues to lower the cleaning device body 8, either through applying a downward force on the handle or simply allowing gravity to lower the cleaning device 2, a portion of the attachment member (e.g., the plastic tray 22) of the replacement head 4 enters into the cavity 21 of the cleaning device head 10. As shown in FIG. 20, a removable mechanical connection is formed when the cleaning device 2 has been fully vertically lowered onto the replacement head 4.

In the embodiment shown, as the cleaning device head 10 is lowered onto the replacement head 4, at least one connector arm 18 or 20 is urged to an open position by the relative angles of the surfaces of the connector arms 18, 20 and downward force of the cleaning device body. Once the attachment member is fully in the cavity 21 and the connector arms 18, 20 have passed below the connector lips 56, 62, the moveable connector arm is able to return to a closed position, thus completing a mechanical connection. Additional angled interior side walls 23 on at least one of the front, back, and/or side of the cavity 21 also assist in urging the cleaning device body and/or the replacement head 4 into proper alignment during the connection process.

Figure 12:
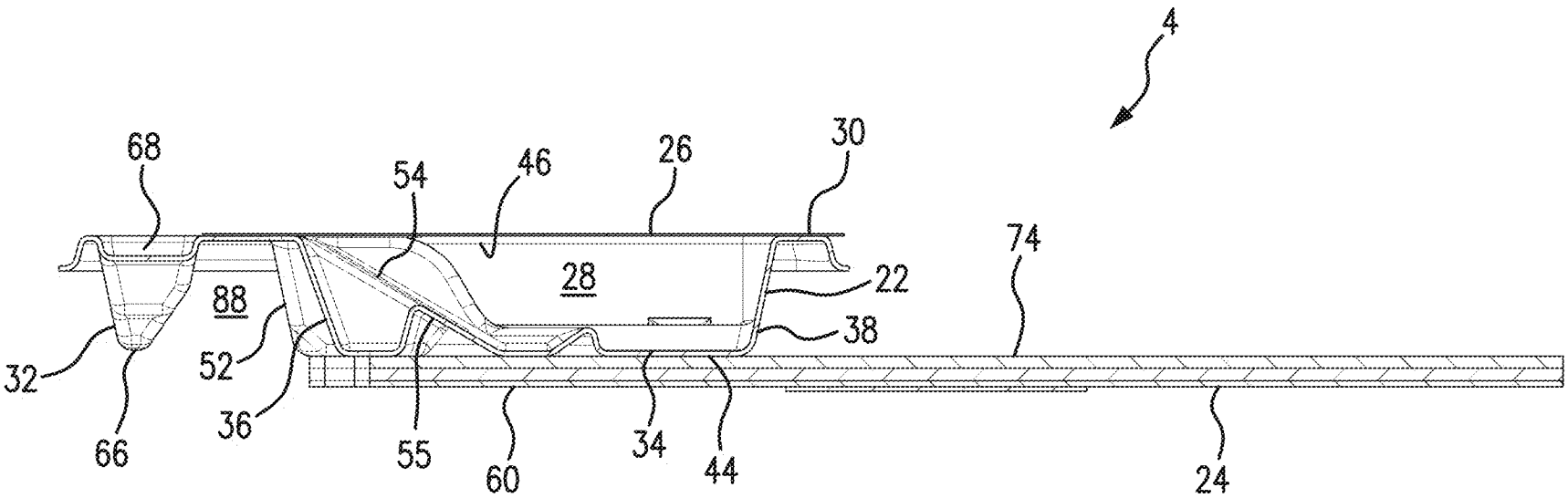
FIG. 12 shows a cross-sectional view of FIG. 4 along line 12-12 depicting the opening cover in a closed position.
Figure 12A:
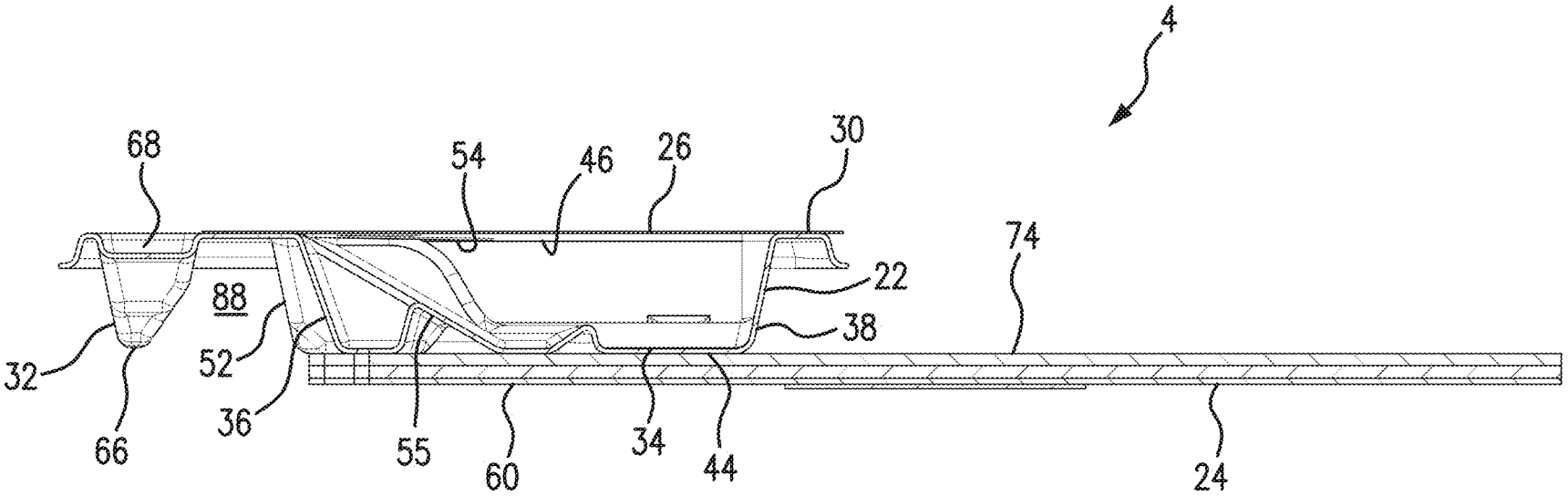
FIG. 12A shows a cross-sectional view of FIG. 4 along line 12A-12A depicting the opening cover in an open position.

In use, and now referring to FIGS. 1-3A, the replacement head 4, when installed such that the filter 26 material is sandwiched between the sealing surface 30 of the plastic tray 22 and the vacuum sealing surface 16, the user activates the cleaning device 2, creating suction. The air drawn into the dust chamber 28 causes the opening cover 54 to move to an open position (as shown in FIG. 12A). As the user moves the cleaning device 2 and replacement head 4 over the floor to be cleaned, the suction source draws air, dirt and debris from the area in front of the replacement head 4 under the front guard 32, and through the opening 52 into the dust chamber 28. The air, dust and debris, once inside the dust chamber 28, are then drawn towards the filter 26 where the air passes through. The dust and debris are not able to pass through the filter 26 and are retained in the dust chamber 28.

As desired, the user may activate the button 14 on the cleaning device 2 to spray fluid onto the floor in front of the replacement head 4. The user can then thoroughly clean the floor using the second surface 60 of the pad 24 to scrub the floor with cleaning fluid.

During the cleaning process, one or more of the following will occur: the dust chamber 28 will fill with dust and debris, the filter 26 will become clogged, and the pad 24 will become soiled. The user, at any time, may selectively replace the replacement head 4 by moving at least one of the connector arms 18, 20 to the open position, thereby releasing the first and second connector lips 56, 62 from engagement with the cleaning device head 10. Advantageously, in the embodiment described, the user can replace the entire replacement head 4 all at once and replace with a refreshed replacement head 4 for future use with minimal mess.

One of skill in the art would know that additional embodiments, or variations to the above description can be made without departing from the spirit or scope of the invention. For example, while various alternatives for connecting the replacement head to the cleaning device head have been disclosed (i.e., first and second connector lips, elastic straps, etc), additional devices that utilize more than one of the disclosed methods or obvious alternatives are considered within the scope of the invention. In addition, the term about is used herein to describe a range of additional values known to one of skill in the art to be equivalent to the stated range. When the term about is used with regard to a range, the term is intended to apply to both ends of the range.

We claim:

1. A replacement head for use with a cleaning device, comprising:

a housing having a dust chamber therein, a suction inlet for allowing debris to flow therethrough into the dust chamber, a portion having an opening configured to couple to a source of suction for drawing debris into the dust chamber through the suction inlet, and at least one mating element protruding from an outermost perimeter of the housing configured to removably mate the housing to a cleaning device.

2. The replacement head of claim 1, wherein the least one mating element extends outward from a sidewall of the dust chamber.

3. The replacement head of claim 1, wherein the dust chamber and the least one mating element are unitary with the housing.

4. The replacement head of claim 1, wherein the at least one mating element is configured to extend into a cavity in the cleaning device.

5. The replacement head of claim 1, further comprising a filter extending across the portion of the housing, the filter being configured to allow a vacuum force to be applied to the dust chamber while retaining debris within the dust chamber.

6. The replacement head of claim 1, further comprising a cleaning sheet coupled to the housing and configured to contact a surface to be cleaned.

7. The replacement head of claim 6, wherein the cleaning sheet is directly attached to the housing.

8. The replacement head of claim 6, wherein an opening of the suction inlet is aligned with an edge of the cleaning sheet.

9. The replacement head of claim 6, wherein the cleaning sheet is planar.

10. The replacement head of claim 1, further comprising a release mechanism on the housing configured to release the housing from a cleaning device.

11. A replacement head for use with a cleaning device, comprising:

a unitary housing having a dust chamber formed therein for receiving and retaining debris, a suction inlet for allowing debris to flow therethrough into the dust chamber, a portion configured to couple to a source of suction, the portion defining a passageway from an interior of the dust chamber to an exterior of the dust chamber, and at least one mating element protruding from an outermost perimeter of the housing configured to removably mate the housing to a cleaning device.

12. The replacement head of claim 11, wherein the least one mating element extends outward from at least one sidewall of the dust chamber.

13. The replacement head of claim 11, further comprising a filter extending across the portion of the housing, the filter being configured to allow a vacuum force to be applied to the dust chamber while retaining debris within the dust chamber.

14. The replacement head of claim 11, further comprising a cleaning sheet coupled to the housing and configured to contact a surface to be cleaned.

15. The replacement head of claim 14, wherein the cleaning sheet is directly attached to the housing.

16. The replacement head of claim 14, wherein an opening of the suction inlet is aligned with an edge of the cleaning sheet.

17. The replacement head of claim 14, wherein the cleaning sheet is planar.

18. A replacement head for use with a cleaning device, comprising:

a housing having a dust chamber therein and a suction inlet for allowing debris to flow therethrough into the dust chamber, the housing including at least one projection extending outward from at least one sidewall of the dust chamber, the at least one projection being configured to removably mate the housing to a cleaning device; and a cleaning pad coupled to the housing and configured to contact a surface to be cleaned.

19. The replacement head of claim 18, further comprising a filter extending across an opening of the housing, the filter being configured to allow a vacuum force to be applied to the dust chamber while retaining debris within the dust chamber.

20. The replacement head of claim 18, wherein the cleaning sheet is directly attached to the housing.

21. The replacement head of claim 18, wherein the cleaning sheet is planar.

* * * * *